US009220376B2

(12) United States Patent
Ohashi et al.

(10) Patent No.: US 9,220,376 B2
(45) Date of Patent: Dec. 29, 2015

(54) SHOWER APPARATUS

(75) Inventors: Takahiro Ohashi, Kitakyushu (JP); Minoru Sato, Kitakyushu (JP); Yutaka Aihara, Kitakyushu (JP); Minami Okamoto, Kitakyushu (JP); Kiyotake Ukigai, Kitakyushu (JP); Katsuya Nagata, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 1012 days.

(21) Appl. No.: 13/139,985

(22) PCT Filed: Dec. 16, 2009

(86) PCT No.: PCT/JP2009/006941

§ 371 (c)(1), (2), (4) Date: Aug. 12, 2011

(87) PCT Pub. No.: WO2010/070904

PCT Pub. Date: Jun. 24, 2010

(65) Prior Publication Data

US 2011/0284662 A1 Nov. 24, 2011

(30) Foreign Application Priority Data

Dec. 17, 2008 (JP) ..... 2008-320566
Dec. 17, 2008 (JP) ..... 2008-320569
Dec. 16, 2009 (JP) ..... 2009-285273

(51) Int. Cl.
*E03C 1/084* (2006.01)
*A47K 3/28* (2006.01)
(Continued)

(52) U.S. Cl.
CPC ..... *A47K 3/28* (2013.01); *B05B 7/0425* (2013.01); *B05B 7/0884* (2013.01); *E03C 1/0409* (2013.01); *E03C 1/084* (2013.01); *B05B 1/18* (2013.01)

(58) Field of Classification Search
CPC ..... E03C 1/0409; E03C 1/084; A47K 3/28; B05B 7/0084; B05B 7/0425; B05B 1/18
USPC ..... 239/428.5, 552–553.5, 567, 556, 548
See application file for complete search history.

(56) References Cited

U.S. PATENT DOCUMENTS 3,537,651 A * 11/1970 Classen ..... 239/428.5
4,211,368 A * 7/1980 Legros et al. ..... 239/315
(Continued)

FOREIGN PATENT DOCUMENTS

CN 2279960 Y 4/1998
DE 102006021801 A1 11/2007
(Continued)

OTHER PUBLICATIONS

International Search Report; PCT/JP2009/006941; Mar. 16, 2010.
(Continued)

*Primary Examiner* — Jason Boeckmann
(74) *Attorney, Agent, or Firm* — Studebaker & Brackett PC

(57) ABSTRACT

A shower apparatus F1 includes a water supply unit 21; a throttle unit 22 installed downstream of the water supply unit 21 and adapted to eject passing water downstream; an aeration unit 23 provided with an opening 231 adapted to produce bubbly water by aerating the water ejected through the throttle unit 22; and a nozzle unit 24 provided with a plurality of nozzle holes 243 adapted to discharge the bubbly water, wherein a virtual water ejection straight line obtained by extending an ejection direction of the water ejected through the throttle unit 22 reaches a location where the nozzle holes 243 are formed, without interfering with inner walls of the aeration unit 23 and the nozzle unit 24.

19 Claims, 25 Drawing Sheets

(51) Int. Cl.

| | |
|---|---|
| ***B05B 7/04*** | (2006.01) |
| ***B05B 7/08*** | (2006.01) |
| ***E03C 1/04*** | (2006.01) |
| *B05B 1/18* | (2006.01) |

(56) References Cited

U.S. PATENT DOCUMENTS

| | | | | |
|---|---|---|---|---|
| 4,789,103 | A * | 12/1988 | Ruhnke | 239/428.5 |
| 5,111,994 | A * | 5/1992 | Gonzalez | 239/428.5 |
| 6,027,044 | A | 2/2000 | Hirata | |
| 6,357,675 | B1 | 3/2002 | Schorn et al. | |
| 2006/0163391 | A1 | 7/2006 | Schorn | |

FOREIGN PATENT DOCUMENTS

| | | | |
|---|---|---|---|
| JP | 53-015934 | | 7/1976 |
| JP | 54-102607 | | 8/1979 |
| JP | 06-209873 | | 8/1994 |
| JP | H06-209873 | A | 8/1994 |
| JP | 06-315654 | | 11/1994 |
| JP | H06-315654 | A | 11/1994 |
| JP | 3014264 | | 5/1995 |
| JP | 3014264 | U | 5/1995 |
| JP | 3021982 | U | 12/1995 |
| JP | 2001-314341 | A | 11/2001 |
| JP | 2002-102100 | A | 4/2002 |
| JP | 3115071 | U | 9/2005 |
| JP | 3747323 | B1 | 2/2006 |
| JP | 2006-509629 | A | 3/2006 |
| WO | 98/08013 | A1 | 2/1998 |

OTHER PUBLICATIONS

The extended European search report issued on Jun. 17, 2013, which corresponds to EP09833211.7 and is related to U.S. Appl. No. 13/139,985.

English translation of the Chinese Office Action "First Notice of Reasons for Rejection" issued on Mar. 1, 2013, which corresponds to Chinese Patent Application No. 200980149609.2 and is related to U.S. Appl. No. 13/139,985.

* cited by examiner

SHOWER APPARATUS

BACKGROUND OF THE INVENTION

1. Field of the Invention

The present invention relates to a shower apparatus.

2. Description of the Related Art

In the present technical field, a shower apparatus is known which discharges bubbly water by aerating water using a so-called ejector effect. The water flowing into the shower apparatus is distributed to multiple nozzle holes and sprayed therefrom. Therefore, when the spray is aerated, the water flowing into the apparatus is aerated before being distributed among the nozzle holes.

An example of such a shower apparatus is proposed in Japanese Patent Laid-Open No. 2006-509629. The shower apparatus described in Japanese Patent Laid-Open No. 2006-509629 comprises a plurality of nozzle holes provided in a front face of a disk-shaped housing shell and is configured to discharge water flowing in through the center of a rear face of the housing shell by distributing the water to the plurality of nozzle holes. The shower apparatus produces bubbly water by aerating the water which has flowed into the housing shell and distributes the bubbly water to the plurality of nozzle holes formed so as to distribute over the entire front face of the disk-shaped housing shell. Therefore, a turbulence generation/expansion unit is placed in a traveling direction of the bubbly water, causing the bubbly water to change direction by colliding with the turbulence generation/expansion unit and thereby spread over the entire front face of the housing shell.

Another example of a shower apparatus is proposed in Japanese Patent No. 3747323. With the shower apparatus described in Japanese Patent No. 3747323, when a cock such as a hot and cold mixer tap is opened, water is supplied from a hose and passed through an orifice member. Then, the water is mixed with air sucked through an inner suction port open to a decompression chamber installed on a downstream side of the orifice member and maintained under reduced pressure at the given moment. The shower apparatus described in Japanese Patent No. 3747323 produces bubbly water in this way and discharges the bubbly water through a plurality of nozzle holes provided in a shower head. With the shower apparatus, the produced bubbly water proceeds to the nozzle holes by changing direction by hitting a threaded member in a partitioned pipe installed on the downstream side of the decompression chamber as well as inner walls of the shower head installed further downstream.

In spraying a shower using bubbly water produced by aerating water, how to set the feel of the bubbly water hitting a user plays an important role in a feeling of quality experienced by the user who takes a shower. The shower apparatus described in Japanese Patent No. 3747323 is intended to achieve the sensation of water hitting the user intermittently as described in paragraph 0015 of Japanese Patent No. 3747323. It is considered that the term "intermittently" means that finely divided water droplets of nonuniform sizes hit the user. Specifically, the user experiences a sensation of a strong shower if hit by large-size water droplets, and a sensation of a weak shower if hit by small-size water droplets. It is considered that the term "intermittently" expresses a mixed sensation of strong and weak showers experienced alternately by the user.

According to concrete studies conducted by the present inventors, it is presumed that in the bubbly water just produced, water is mixed substantially uniformly with air. Then, the bubbles collide with each other as the produced bubbly water changes direction by hitting the threaded member and the inner walls of the shower head, and it is considered that bubble diameters are nonuniform when the bubbly water reaches the nozzle holes. Consequently, when discharged from the nozzle holes, the bubbly water turns into water droplets of nonuniform sizes, which are considered to achieve the sensation described above when directed at the user.

On the other hand, Japanese Patent Laid-Open No. 2006-509629 does not give any description of properties of the bubbly water discharged from the shower apparatus described in Japanese Patent Laid-Open No. 2006-509629. However, judging from what is described in Japanese Patent Laid-Open No. 2006-509629, it is presumed that the shower apparatus produces water droplets of nonuniform sizes by supplying and discharging bubbly water with nonuniform bubble diameters from the nozzle holes and directs the water droplets of nonuniform sizes at the user, as in the case of the shower apparatus described in Japanese Patent No. 3747323. This presumption is based on the following grounds. First, in the shower apparatus described in Japanese Patent Laid-Open No. 2006-509629, the turbulence generation/expansion unit is placed in the traveling direction of the bubbly water, causing the bubbly water to change direction by colliding with the turbulence generation/expansion unit. In view of the configuration, it is considered that similar nonuniform bubble growth takes place in the shower apparatus described in Japanese Patent No. 3747323 and that resulting water droplets of nonuniform sizes are directed at the user.

Under these circumstances, the present inventors intended to provide a shower apparatus which enables spray of a shower with a comfortable voluminous feel as if one were showered by large drops of rain. In contrast, the above-described conventional techniques achieve the sensation of nonuniformly-sized water droplets hitting the user as described above. Thus, the conventional techniques do not provide spray of a comfortable shower with a voluminous feel as if the user were showered by large drops of rain.

To provide spray of a shower with such a new feel, the present inventors paid attention to the state of bubbly water in nozzle holes and just after discharge from the nozzle holes. In the nozzle holes and after discharge from the nozzle holes, the bubbly water is in a state of gas-liquid, two-phase flow in which two different types of fluid—gas and liquid—coexist and move in the same flow conduit. Therefore, the bubbly water is considered to be flowing in any of the typical flow patterns of bubble flow, slug flow, and annular flow. Since these flow patterns differ in the manner of bubble inclusion, it is considered that they also differ in the manner of fine division after discharge from the nozzle holes. Therefore, the present inventors presumed that with the conventional techniques, since the bubble diameters in the bubbly water supplied to the nozzle holes are nonuniform, the bubbly water is discharged under the coexistence of bubble flow, slug flow, and annular flow, resulting in the sensation of nonuniformly-sized water droplets hitting the user. Thus, the present inventors considered it important to control the bubble diameters of the bubbly water supplied to the nozzle holes to be uniform.

However, water is normally supplied to a shower apparatus through a single supply port. Furthermore, bubbly water is produced by aerating the water supplied through the single supply port. Although water is supplied to the shower apparatus in this way, multiple nozzle holes are provided. Therefore, the bubbly water is stimulated when being distributed to the nozzle holes by changing the direction of the bubbly water. This makes it extremely difficult to discharge the water from the nozzle holes without causing the air bubbles to grow.

SUMMARY OF THE INVENTION

The present invention has been made in view of the above problem and has an object to provide a shower apparatus which can supply bubbly water to the nozzle holes by keeping bubble diameter in the bubbly water as uniform as possible, and thereby cause water droplets of relatively large, uniform size to land continuously on the user so as to allow the user to enjoy a shower with a voluminous feel as if the user were showered by large drops of rain.

To solve the above problem, the present invention provides a shower apparatus for discharging aerated bubbly water, comprising: a water supply unit adapted to supply water; a throttle unit installed downstream of the water supply unit and adapted to make a cross sectional area of a flow channel smaller than the water supply unit and thereby eject passing water downstream; an aeration unit installed downstream of the throttle unit and provided with an opening adapted to produce the bubbly water by aerating the water ejected through the throttle unit; and a nozzle unit installed downstream of the aeration unit and provided with a plurality of nozzle holes adapted to discharge the bubbly water by being formed along an ejection direction of the water ejected through the throttle unit, wherein a virtual water ejection straight line obtained by extending the ejection direction of the water ejected through the throttle unit reaches a location where the nozzle holes are formed, without interfering with inner walls of the aeration unit and the nozzle unit.

According to the present invention, the water supplied from the water supply unit is ejected to the aeration unit and nozzle unit through the throttle unit, temporarily pooled in the aeration unit and nozzle unit, and subsequently discharged outside through the plurality of nozzle holes in the nozzle unit. By involving air taken in through the opening formed in the aeration unit, the water ejected through the throttle unit plunges into an air-liquid interface between air and the water temporarily pooled in the aeration unit and nozzle unit and thereby turns into bubbly water. The bubbly water thus generated is sprayed through the plurality of nozzle holes in the nozzle unit. According to the present invention, the virtual water ejection straight line obtained by extending the ejection direction of the water ejected from the throttle unit is configured to reach the location where the nozzle holes are formed, without interfering with the inner walls of the aeration unit and nozzle unit. Consequently, the water ejected from the throttle unit reaches the location where the nozzle holes are formed without having its flow disturbed by the inner walls of the aeration unit and nozzle unit.

In a stage in which the water ejected through the throttle unit plunges into the air-liquid interface and thereby turns into bubbly water, the air bubbles in the bubbly water can be configured to have a substantially uniform diameter. Thus, the bubbly water can reach the location where the nozzle holes are formed while maintaining the substantially uniform diameter. As the bubbly water containing air bubbles of a substantially uniform diameter is supplied to the nozzle holes, a bubble flow or slug flow can be formed in the nozzle holes or just after discharge from the nozzle holes. When discharged from the nozzle holes, the bubbly water containing air bubbles of such a substantially uniform diameter and formed as a bubble flow or slug flow in this way is finely divided substantially uniformly by being sheared in a direction substantially orthogonal to a discharge direction without being turned into a mist as in the case of an annular flow. This causes water droplets of relatively large, uniform size to land continuously on the user and thereby allows the user to enjoy a shower with a voluminous feel as if the user were showered by large drops of rain.

Also, in the shower apparatus according to the present invention, preferably the throttle unit is made up of a plurality of throttle channels arranged side by side; and each of a plurality of the virtual water ejection straight lines obtained by extending the ejection direction of the water ejected from each of the plurality of throttle channels reaches a location where the nozzle holes are formed, without interfering with the inner walls of the aeration unit and the nozzle unit.

According to this preferred aspect, since the throttle unit is made up of the plurality of throttle channels arranged side by side, the water ejected from the plurality of throttle channels plunges into the air-liquid interface side by side. As the water plunges into the air-liquid interface in this way, the water temporarily pooled in the aeration unit and nozzle unit turns into bubbly water. Therefore, when air bubbles are generated from the water ejected from adjacent throttle channels, water streams formed by the plunging water affect each other and tear the air bubbles generated by each other, achieving the effect of reducing the bubble diameter of the generated air bubbles. This makes it possible to feed the bubbly water containing air bubbles substantially equal and relatively small in diameter into nozzle holes. Consequently, the bubbly water can form a bubble flow or slug flow reliably in the nozzle holes or just after discharge from the nozzle holes, causing water droplets of relatively large, uniform size to land reliably and steadily on the user. This allows the user to enjoy a more comfortable shower with a voluminous feel as if the user were showered by large drops of rain.

Also, in the shower apparatus according to the present invention, preferably that cross section of each of the aeration unit and the nozzle unit which is orthogonal to the ejection direction of the water ejected from the plurality of throttle channels is formed into a flat shape whose longer sides run along a direction in which the plurality of throttle channels are arranged side by side.

According to this preferred aspect, the cross section of each of the aeration unit and nozzle unit is formed into a flat shape whose longer sides run along the direction in which the plurality of throttle channels are arranged side by side. Thus, the aeration unit and nozzle unit are formed to be narrow in the direction orthogonal to the direction in which the plurality of throttle channels are arranged side by side, and wide in the direction in which the plurality of throttle channels are arranged side by side. This makes the bubbly water resistant to diffusion in the direction orthogonal to the direction in which the plurality of throttle channels are arranged side by side, and consequently the air bubbles in the bubbly water do not diffuse easily in that direction. Therefore, by expanding the cross sections of the aeration unit and nozzle unit in the direction in which the plurality of throttle channels are arranged side by side, a plurality of water streams can be caused to affect each other, achieving the effect of tearing the air bubbles. On the other hand, in the direction orthogonal to the side-by-side arrangement direction, collisions among the generated air bubbles can be reduced, allowing the bubbly water to reach the nozzle holes by maintaining more uniform bubble diameter.

Also, in the shower apparatus according to the present invention, preferably the throttle unit is made up of the plurality of throttle channels arranged side by side in each of a plurality of tiers.

According to this preferred aspect, the plurality of throttle channels are arranged side by side in each of a plurality of tiers. Consequently, each throttle channel is configured to neighbor the throttle channels formed in adjacent tiers in addition to the throttle channels formed in the same tier. Thus, a larger number of throttle channels are formed next to each other than when a plurality of throttle channels are arranged side by side in a single tier, enhancing interactions among the water streams formed by the water which plunges into the air-liquid interface by being ejected from the throttle channels. This enhances the effect of tearing the air bubbles generated by the water streams of each other, and achieves the effect of reducing the bubble diameter of the generated air bubbles more reliably. Furthermore, a plurality of throttle channels are arranged side by side in each of a plurality of tiers. This makes it possible to reduce the lateral width of the cross section of the portion in which the plurality of throttle channels are formed i.e., the length in the direction along which the plurality of throttle channels are arranged side by side. In this way, by reducing the lateral width of the cross-sectional shape of the portion in which the plurality of throttle channels are formed, it is possible to reduce circumferential length of the portion even if the cross sectional area of the throttle channels is the same. Consequently, for example, when the throttle unit, aeration unit, and nozzle unit are made of separate components, reliability of surface sealing among the separate components can be improved.

Also, in the shower apparatus according to the present invention, preferably the plurality of throttle channels arranged side by side are placed alternately in the plurality of tiers such that each throttle channel will be placed at an equal distance to a respective pair of throttle channels installed in an adjacent tier.

According to this preferred aspect, since the throttle channels are arranged regularly such that each throttle channel will be placed at an equal distance to the respective pair of throttle channels installed in the adjacent tier, it is possible to maximize the number of throttle channels closest to each throttle channel. Consequently, as a larger number of throttle channels are formed closest to each other, it is possible to further enhance the interactions among the water streams formed by the water which plunges into the air-liquid interface by being ejected from the throttle channels, further enhance the effect of tearing the air bubbles generated by the water streams of each other, and achieve the effect of reducing the bubble diameter of the generated air bubbles more reliably.

Also, in the shower apparatus according to the present invention, preferably those side walls of each of the aeration unit and the nozzle unit which face each other across the ejection direction of the water ejected from the throttle unit are placed so as to be parallel to each other.

According to this preferred aspect, the side walls of each of the aeration unit and the nozzle unit are placed so as to be parallel to each other, where the side walls provide flow channels through which the water ejected from the throttle channels pass. This placement provides straight flow channels for the water ejected from the throttle channels to pass through. This makes it possible to reduce water turbulence produced when the water ejected from the throttle channels plunges into the air-liquid interface and supply bubbly water of uniform bubble diameter to the nozzle holes.

Also, in the shower apparatus according to the present invention, preferably the throttle unit is made up of a plurality of throttle channels arranged radially; and each of a plurality of the virtual water ejection straight lines obtained by extending the ejection direction of the water ejected from each of the plurality of throttle channels reaches a location where the nozzle holes are formed, without interfering with the inner walls of the aeration unit and the nozzle unit.

According to the present invention, the virtual water ejection straight lines obtained by extending the ejection direction of the water ejected from the throttle unit is configured to reach the location where the nozzle holes are formed, without interfering with the inner walls of the aeration unit and nozzle unit. Consequently, the water ejected from the throttle unit reaches the location where the nozzle holes are formed without having its flow disturbed by the inner walls of the aeration unit and nozzle unit. This causes water droplets of relatively large, uniform size to land continuously on the user and thereby allows the user to enjoy a shower with a voluminous feel as if the user were showered by large drops of rain. Furthermore, according to this preferred aspect, the plurality of throttle channels of the throttle unit are arranged radially. This placement causes the cross sectional area of the flow channel for the water ejected from the plurality of throttle channels to become larger in the direction of flow. This makes interference among water streams less liable to occur when the water ejected from the plurality of throttle channels plunges into the air-liquid interface and thereby allows the bubbly water containing air bubbles of a substantially uniform diameter to be supplied to the nozzle holes.

However, the present inventors found that adoption of the configuration described above posed a new problem not encountered conventionally: namely, the configuration makes it difficult to discharge water from the nozzle holes placed on the side of the aeration unit out of the plurality of nozzle holes formed in the nozzle unit. Thus, the present inventors came up with the idea of supplying bubbly water to the nozzle holes by keeping the bubble diameter in the bubbly water as uniform as possible. Consequently, the present inventors have made the following invention intended to provide a shower apparatus which can stably discharge water through all nozzle holes, and thereby cause water droplets of relatively large, uniform size to land continuously on the user so as to allow the user to enjoy a shower with a voluminous feel as if the user were showered by large drops of rain.

To solve this new problem, the present invention provides a shower apparatus for discharging aerated bubbly water, comprising: a water supply unit adapted to supply water; a throttle unit installed downstream of the water supply unit and adapted to make a cross sectional area of a flow channel smaller than the water supply unit and thereby eject passing water downstream; an aeration unit installed downstream of the throttle unit and provided with an opening adapted to produce the bubbly water by aerating the water ejected through the throttle unit; and a nozzle unit installed downstream of the aeration unit and provided with a plurality of nozzle holes adapted to discharge the bubbly water by being formed along an ejection direction of the water ejected through the throttle unit, wherein a virtual water ejection straight line obtained by extending the ejection direction of the water ejected through the throttle unit reaches a location where the nozzle holes are formed, without interfering with inner walls of the aeration unit and the nozzle unit, the bubbly water is produced when the water ejected from the throttle unit plunges into an air-liquid interface between air and the water temporarily pooled in the aeration unit and nozzle unit, and the shower apparatus further comprises deceleration means adapted to decelerate the water plunging into the air-liquid interface, before reaching first-row nozzle holes formed closest to the side of the aeration unit out of the plurality of nozzle holes.

According to the present invention, the water supplied from the water supply unit is ejected to the aeration unit and nozzle unit through the throttle unit, temporarily pooled in the aeration unit and nozzle unit, and subsequently discharged outside through the plurality of nozzle holes in the nozzle unit. By involving air taken in through the opening formed in the aeration unit, the water ejected through the throttle unit plunges into the air-liquid interface between air and the water temporarily pooled in the aeration unit and nozzle unit and thereby turns into bubbly water. The bubbly water thus generated is sprayed through the plurality of nozzle holes in the nozzle unit. In the case of the present invention, the virtual water ejection straight lines obtained by extending the ejection direction of the water ejected from the throttle unit is configured to reach the location where the nozzle holes are formed, without interfering with the inner walls of the aeration unit and nozzle unit. Consequently, the water ejected from the throttle unit reaches the location where the nozzle holes are formed without having its flow disturbed by the inner walls of the aeration unit and nozzle unit.

In a stage in which the water ejected through the throttle unit plunges into the air-liquid interface and thereby turns into bubbly water, the air bubbles in the bubbly water can be configured to have a substantially uniform diameter. Thus, the bubbly water can reach the location where the nozzle holes are formed while maintaining the substantially uniform bubble diameter. As the bubbly water containing air bubbles of a substantially uniform diameter is supplied to the nozzle holes, a bubble flow or slug flow can be formed in the nozzle holes or just after discharge from the nozzle holes. When discharged from the nozzle holes, the bubbly water containing air bubbles of such a substantially uniform diameter and formed as a bubble flow or slug flow in this way is finely divided substantially uniformly by being sheared in a direction substantially orthogonal to a discharge direction without being turned into a mist as in the case of an annular flow. This causes water droplets of relatively large, uniform size to land continuously on the user and thereby allows the user to enjoy a shower with a voluminous feel as if the user were showered by large drops of rain.

Furthermore, according to the present invention, the water ejected through the throttle unit and plunging into the air-liquid interface is configured to be decelerated by the deceleration means before reaching the first-row nozzle holes formed closest to the aeration unit out of the plurality of nozzle holes. This makes it possible to reliably avoid a situation in which the water plunging into the air-liquid interface will rush past the first-row nozzle holes on the near side by its own momentum. Therefore, the bubbly water produced by the water plunging into the air-liquid interface is decelerated sufficiently before reaching the first-row nozzle holes, so as to be discharged through the first-row nozzle holes. This allows the bubbly water to be discharged stably and evenly through all the nozzle holes including the first-row nozzle holes.

Also, in the shower apparatus according to the present invention, preferably the deceleration means comprises cross sectional area varying means formed in the aeration unit to reduce, on the side of the throttle unit, a cross sectional area orthogonal to the ejection direction of the water ejected from the throttle unit.

According to this preferred aspect, the deceleration means is implemented by the cross sectional area varying means formed in the aeration unit to reduce, on the side of the throttle unit, the cross sectional area orthogonal to the ejection direction of the water ejected from the throttle unit. Consequently, the narrowed portion can hold back the air-liquid interface, which is formed when the water ejected from the throttle unit is temporarily pooled in the nozzle unit, from moving back toward the throttle unit. This ensures that the air-liquid interface will be positioned between the throttle unit and the first-row nozzle holes of the nozzle unit and that the water plunging into the air-liquid interface will be decelerated before reaching the first-row nozzle holes. Consequently, the bubbly water can be discharged reliably through all the nozzle holes including the first-row nozzle holes.

Also, in the shower apparatus according to the present invention, preferably the cross sectional area varying means is configured by varying, in the aeration unit, the cross sectional area orthogonal to the ejection direction of the water ejected from the throttle unit, in a direction along a plane in which the nozzle holes of the nozzle unit are formed.

According to this preferred aspect, the cross sectional area varying means is configured by varying the cross sectional area orthogonal to the water ejection direction of the aeration unit in a direction along the plane in which the nozzle holes are formed. Since the cross sectional area varying means is configured in this way, when the water plunging into the air-liquid interface is decelerated, the direction of flow corresponds to a direction along the plane in which the nozzle holes are formed rather than a direction intersecting the plane in which the nozzle holes are formed. Consequently, water flow is less liable to occur in the direction intersecting the plane in which the nozzle holes are formed. This causes water to get easily distributed evenly to the nozzle holes formed in the nozzle unit. For example, it becomes difficult for a flow of water not oriented in a water discharge direction to be produced in a region where the first-row nozzle holes are formed. Such a flow of water would jump over the first-row nozzle holes. Consequently, the bubbly water can be discharged reliably through all the nozzle holes including the first-row nozzle holes.

Also, in the shower apparatus according to the present invention, preferably the cross sectional area varying means is configured by gradually varying, in the aeration unit, the cross sectional area orthogonal to the ejection direction of the water ejected from the throttle unit.

According to this preferred aspect, the cross sectional area varying means is configured by gradually varying, in the aeration unit, the cross sectional area orthogonal to the ejection direction of the water ejected from the throttle unit. Since the cross sectional area varying means is configured in this way, the water plunging into the air-liquid interface in the aeration unit flows along side faces which change gradually. This makes it difficult for the flow of water to stagnate, swirl, or otherwise get disturbed after plunging into the air-liquid interface in the aeration unit, and thereby allows the bubbly water to be discharged reliably through all the nozzle holes including the first-row nozzle holes.

Also, in the shower apparatus according to the present invention, preferably the deceleration means comprises position control means adapted to position the air-liquid interface between the throttle unit and the first-row nozzle holes.

According to this preferred aspect, the air-liquid interface is placed closer to the throttle unit than to the first-row nozzle holes by the position control means. Consequently, the water ejected through the throttle unit can be decelerated sufficiently by resistance of water existing between the air-liquid interface and the first-row nozzle holes. Thus, by simply using the resistance of the water existing between the air-liquid interface and the first-row nozzle holes, the water plunging into the air-liquid interface can be decelerated before the water reaches the first-row nozzle holes, so as to be able to be discharged through the first-row nozzle holes. Consequently, the bubbly water can be discharged stably and evenly through all the nozzle holes.

Also, in the shower apparatus according to the present invention, preferably the position control means is configured by placing a plurality of throttle channels in parallel in the throttle unit.

According to this preferred aspect, since the throttle unit is made up of a plurality of throttle channels placed in parallel with each other, the water ejected from the plurality of throttle channels plunges into the air-liquid interface in parallel streams. Therefore, forces exerted by the ejected water can be transmitted evenly to all over the air-liquid interface, making it possible to stably position the air-liquid interface closer to the throttle unit than to the first-row nozzle holes. Consequently, the water can more stably be discharged evenly through all the nozzle holes.

Also, in the shower apparatus according to the present invention, preferably the throttle unit is configured by placing the plurality of throttle channels in parallel with each other in a plurality of tiers.

According to this preferred aspect, the throttle unit is configured by placing the plurality of throttle channels in parallel with each other among a plurality of tiers as well as in each of the plurality of tiers. Consequently, the water is ejected from the throttle channels in parallel streams among the plurality of tiers, and plunges into the air-liquid interface, almost maintaining this state. Therefore, the forces exerted by the ejected water can be transmitted evenly to all over the air-liquid interface, spreading more widely in two-dimensional directions. This makes it possible to more stably place the air-liquid interface closer to the throttle unit than to the first-row nozzle holes. Furthermore, since the plurality of throttle channels are placed in parallel with each other in each of the plurality of tiers, it is possible to reduce the lateral width of the cross section of the portion in which the plurality of throttle channels are formed, i.e., the length in the direction along which the plurality of throttle channels are placed in parallel with each other in each tier. In this way, by reducing the lateral width of the cross-sectional shape of the portion in which the plurality of throttle channels are formed, it is possible to reduce circumferential length of the cross section of the portion even if the cross sectional area of the throttle channels is the same. Consequently, for example, when the throttle channels, aeration unit, and nozzle unit are made of separate components, the reliability of surface sealing can be improved.

Also, in the shower apparatus according to the present invention, preferably the position control means comprises an abrupt expansion portion adapted to abruptly expand, along a traveling direction of the water, the cross sectional area orthogonal to the ejection direction of the water ejected from the throttle unit in the aeration unit.

According to this preferred aspect, the abrupt expansion portion of the position control means abruptly expands, along the traveling direction of the water, the cross sectional area orthogonal to the ejection direction of the water ejected from the throttle unit in the aeration unit. For that, the abrupt expansion portion can have a step formed on an inner wall of the aeration unit. Consequently, although the air-liquid interface, which is formed when the water ejected from the throttle unit is temporarily pooled in the nozzle unit, advances from the nozzle unit toward the throttle unit, the advance is interrupted by the step in the abrupt expansion portion. This makes it possible to perform control so as to position the air-liquid interface reliably between the nozzle unit and throttle unit.

Also, in the shower apparatus according to the present invention, preferably the abrupt expansion portion expands the cross sectional area on the side where the nozzle holes are formed in the nozzle unit.

According to this preferred aspect, the abrupt expansion portion is formed by expanding the cross sectional area on the side where the nozzle holes are formed. Since the abrupt expansion portion is formed in this way, after the water ejected from the throttle unit plunges into the air-liquid interface, a flow is generated, moving toward the nozzle holes along the wider side of the abrupt expansion portion. This makes it possible to direct the water reliably toward that side of the nozzle unit on which the nozzle holes are formed, and thereby discharge water reliably through the nozzle holes.

With the adoption of the configuration described above, even when the virtual water ejection straight lines obtained by extending the ejection direction of the water ejected in the aeration unit from the throttle unit is configured to reach the location where the nozzle holes are formed, without interfering with the inner walls of the aeration unit and nozzle unit, the present inventors found a new problem not encountered conventionally: namely, the bubble diameters in the bubbly water supplied to the nozzle holes are not always uniform. Thus, the present inventors have made the following invention aimed at providing shower apparatus which can cause water droplets of relatively large, uniform size to land continuously on the user by more reliably supplying bubbly water whose bubble diameter is kept as uniform as possible to the nozzle holes and thereby allow the user to enjoy a shower with a voluminous feel as if the user were showered by large drops of rain.

To solve this new problem, the present invention provides a shower apparatus for discharging aerated bubbly water, comprising: a water supply unit adapted to supply water; a throttle unit installed downstream of the water supply unit and adapted to make a cross sectional area of a flow channel smaller than the water supply unit and thereby eject passing water downstream; an aeration unit installed downstream of the throttle unit and provided with an opening adapted to produce the bubbly water by aerating the water ejected through the throttle unit; and a nozzle unit installed downstream of the aeration unit and provided with a plurality of nozzle holes adapted to discharge the bubbly water by being formed along an ejection direction of the water ejected through the throttle unit, wherein a virtual water ejection straight line obtained by extending the ejection direction of the water ejected through the throttle unit reaches a location where the nozzle holes are formed, without interfering with inner walls of the aeration unit and the nozzle unit, the bubbly water is produced when the water ejected from the throttle unit plunges into an air-liquid interface between air and the water temporarily pooled in the aeration unit and nozzle unit, and the shower apparatus further comprises eddy reduction means adapted to reduce eddies generated in the nozzle unit by the water plunging into the air-liquid interface.

According to the present invention, the water supplied from the water supply unit is ejected to the aeration unit and nozzle unit through the throttle unit, temporarily pooled in the aeration unit and nozzle unit, and subsequently discharged outside through the plurality of nozzle holes in the nozzle unit. By involving air taken in through the opening formed in the aeration unit, the water ejected through the throttle unit plunges into the air-liquid interface between air and the water temporarily pooled in the aeration unit and nozzle unit and thereby turns into bubbly water. The bubbly water thus generated is sprayed through the plurality of nozzle holes in the nozzle unit. In the case of the present invention, the virtual water ejection straight lines obtained by extending the ejection direction of the water ejected from the throttle unit is configured to reach the location where the nozzle holes are formed, without interfering with the inner walls of the aeration unit and nozzle unit. Consequently, the water ejected from the throttle unit reaches the location where the nozzle holes are formed without having its flow disturbed by the inner walls of the aeration unit and nozzle unit.

In a stage in which the water ejected through the throttle unit plunges into the air-liquid interface and thereby turns into bubbly water, the air bubbles in the bubbly water can be configured to have a substantially uniform diameter. Thus, the bubbly water can reach the location where the nozzle holes are formed while maintaining the substantially uniform diameter. As the bubbly water containing air bubbles of a substantially uniform diameter is supplied to the nozzle holes, a bubble flow or slug flow can be formed in the nozzle holes or just after discharge from the nozzle holes. When discharged from the nozzle holes, the bubbly water containing air bubbles of such a substantially uniform diameter and formed as a bubble flow or slug flow in this way is finely divided substantially uniformly by being sheared in a direction substantially orthogonal to a discharge direction without being turned into a mist as in the case of an annular flow. This causes water droplets of relatively large, uniform size to land continuously on the user and thereby allows the user to enjoy a shower with a voluminous feel as if the user were showered by large drops of rain.

Furthermore, according to the present invention, the eddy reduction means adapted to reduce eddies generated in the nozzle unit by the water plunging into the air-liquid interface can reduce eddies generated when a stream flowing past the nozzle holes and reaching inner walls in deep part of the nozzle unit returns therefrom. As described above, the present invention is configured such that after plunging into the air-liquid interface, the flow of the water will not be disturbed by the inner wall surfaces of the aeration unit and nozzle unit before reaching the nozzle holes on a primary basis. The eddy reduction means can prevent the water reaching the nozzle holes on a secondary basis from swirling when the water stream reaching the inner wall surfaces in the deep part of the nozzle unit returns therefrom. This makes it possible to prevent a situation in which eddies generated in the nozzle unit would cause collisions of air bubbles, facilitating growth in bubble diameter and resulting in air bubbles of nonuniform diameter. As a result, the bubble diameters in the bubbly water supplied to the nozzle holes can be made uniform. In this way, since greater care is taken to suppress bubble growth in the nozzle unit, the present invention can further ensure that the bubble diameters in the bubbly water supplied to the nozzle holes will be made uniform. This causes water droplets of relatively large, uniform size to land continuously on the user, further ensuring that the user can enjoy a shower with a voluminous feel as if the user were showered by large drops of rain.

Also, in the shower apparatus according to the present invention, preferably the eddy reduction means comprises rod-shaped projections configured to project into the nozzle unit and adapted to divide a water stream generated in the nozzle unit by the water plunging into the air-liquid interface into substreams.

According to this preferred aspect, the eddy reduction means is implemented by the rod-shaped projections projecting into the nozzle unit. This configuration causes the water stream generated in the nozzle unit to be divided by the water plunging into the air-liquid interface into substreams and thereby curbs generation of eddies in the nozzle unit. More specifically, when the water stream generated in the nozzle unit by the water plunging into the air-liquid interface is divided into substreams, the water stream can be decelerated before reaching the inner wall surfaces in the deep part of the nozzle unit. This prevents the water reaching the inner wall surfaces in the deep part of the nozzle unit from turning back therefrom, and thereby prevents a rerun stream from generating a large eddy in the nozzle unit. This in turn reliably prevents collisions among air bubbles in the nozzle unit and thereby further ensures that the user can enjoy a shower with a voluminous feel as if the user were showered by large drops of rain.

Also, in the shower apparatus according to the present invention, preferably the rod-shaped projections and the nozzle holes are arranged so as not to overlap in a heading direction of the water stream generated in the nozzle unit by the water plunging into the air-liquid interface; and the water stream generated in the nozzle unit by the water plunging into the air-liquid interface is divided by the rod-shaped projections and the resulting substreams tending to spread in a lateral direction are caught by the nozzle holes and thereby discharged before spreading excessively.

When eddy reduction means is made up of the rod-shaped projections projecting into the nozzle unit and the water stream generated in the nozzle unit by the water plunging into the air-liquid interface is divided into substreams to curb generation of eddies in the nozzle unit as with the present invention, it is conceivable that air bubbles are liable to collide with one another depending on conditions. Specifically, the substreams resulting from the division by the rod-shaped projections head in a lateral direction with respect to the traveling direction of the original water stream, and the substreams produced by adjacent rod-shaped projections collide with each other, which in turn could cause air bubbles to collide with each other. Thus, according to this preferred aspect, the rod-shaped projections and the nozzle holes are arranged so as not to overlap in the heading direction of the water stream generated in the nozzle unit by the water plunging into the air-liquid interface. This arrangement can make it easy for the nozzle holes to catch the substreams produced by the rod-shaped projections and tending to spread in a lateral direction. Consequently, the substreams are discharged before spreading excessively. This reliably prevents not only eddies produced by the return stream, but also collisions among air bubbles in the nozzle unit caused by collisions among substreams. This further ensures that the user can enjoy a shower with a voluminous feel as if the user were showered by large drops of rain.

Also, in the shower apparatus according to the present invention, preferably a plurality of the rod-shaped projections are installed, being scattered in a depth direction of the nozzle unit corresponding to the heading direction of the water stream, so as to be able to divide the water stream generated in the nozzle unit by the water plunging into the air-liquid interface into substreams a plurality of times.

According to this preferred aspect, by being scattered in the depth direction of the nozzle unit corresponding to the heading direction of the water stream, the plurality of rod-shaped projections can divide the water stream generated in the nozzle unit into substreams a plurality of times. Consequently, the water stream generated in the nozzle unit can be decelerated stepwise at a number of separate times, making it possible to avoid collisions of air bubbles feared to occur when the water stream generated in the nozzle unit is decelerated. Thus, the stepwise deceleration makes it possible to curb generation of large eddies due to a return stream as well as to avoid rapid deceleration and thereby reliably prevent collisions among air bubbles in the nozzle unit. This further ensures that the user can enjoy a shower with a voluminous feel as if the user were showered by large drops of rain.

Also, in the shower apparatus according to the present invention, preferably the rod-shaped projections are configured to allow the substreams to reunite.

According to this preferred aspect, since the rod-shaped projections are configured to allow the substreams separated by the rod-shaped projections to reunite, the substreams are configured to get decelerated and reunite while heading in the traveling direction of the original water stream. This reliably prevents the traveling direction of the substreams from becoming irregular, and thereby can prevent collisions among the substreams and collisions among air bubbles. This further ensures that the user can enjoy a shower with a voluminous feel as if the user were showered by large drops of rain.

Also, in the shower apparatus according to the present invention, preferably the plurality of the rod-shaped projections are installed, being lined up along the heading direction of the water stream generated in the nozzle unit by the water plunging into the air-liquid interface.

According to this preferred aspect, since the plurality of the rod-shaped projections are installed, being lined up along the heading direction of the water stream generated in the nozzle unit, the substreams can be decelerated reliably while maintaining orientation in the traveling direction of the water stream. This reliably prevents the traveling directions of the water streams and substreams from becoming irregular, thereby prevents collisions among the water streams or substreams, and thereby prevents collisions among air bubbles. This further ensures that the user can enjoy a shower with a voluminous feel as if the user were showered by large drops of rain.

Also, in the shower apparatus according to the present invention, preferably those side faces of the rod-shaped projections which face the throttle unit are configured to protrude toward the throttle unit.

According to this preferred aspect, since those side faces of the rod-shaped projections which face the throttle unit are configured to protrude toward the throttle unit, it is possible to reduce resistance produced when the water stream traveling in the nozzle unit is divided into substreams by hitting the rod-shaped projections and thereby prevent collisions among air bubbles. This further ensures that the user can enjoy a shower with a voluminous feel as if the user were showered by large drops of rain.

The present invention provides a shower apparatus which can supply bubbly water to the nozzle holes by keeping bubble diameter in the bubbly water as uniform as possible, and thereby cause water droplets of relatively large, uniform size to land continuously on the user so as to allow the user to enjoy a shower with a voluminous feel as if the user were showered by large drops of rain.

BRIEF DESCRIPTION OF THE DRAWINGS

FIG. 1A is a plan view, FIG. 1B is a side view, and FIG. 1C is a bottom view;

FIG. 8A is a plan view, FIG. 8B is a side view, and FIG. 8C is a bottom view;

FIG. 14A is a plan view, FIG. 14B is a side view, and FIG. 14C is a bottom view;

FIG. 16A is a plan view, FIG. 16B is a side view, and FIG. 16C is a bottom view;

DETAILED DESCRIPTION OF THE PREFERRED EMBODIMENTS

Figure 1A:
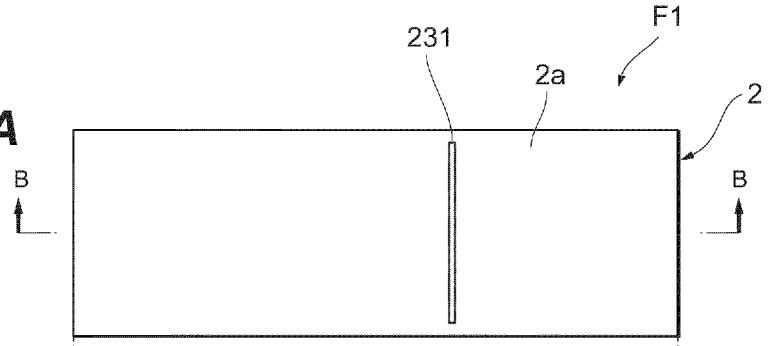
FIGS. 1A to 1C are diagrams showing a shower apparatus according to a first embodiment of the present invention, where

An embodiment of the present invention will be described below with reference to the accompanying drawings. To facilitate understanding of the description, the same components in different drawings are denoted by the same reference numerals whenever possible and redundant description thereof will be omitted.

Figure 1B:
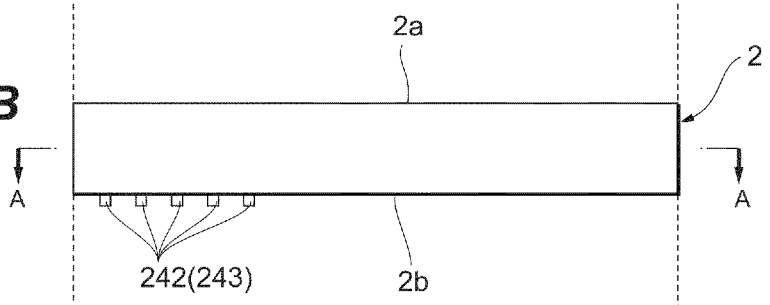
Figure 1C:
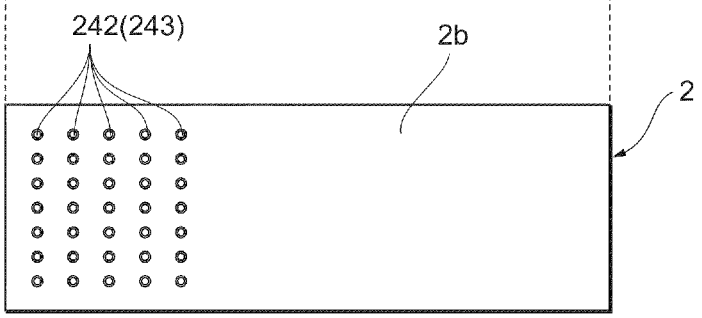

A shower apparatus which is a first embodiment of the present invention will be described with reference to FIGS. 1A to 1C, which are diagrams showing a shower apparatus F1 according to the first embodiment of the present invention, where FIG. 1A is a plan view, FIG. 1B is a side view, and FIG. 1C is a bottom view. As shown in FIG. 1A, the shower apparatus F1 mainly includes a body 2 shaped as an approximately rectangular parallelepiped, and an opening 231 is formed in a top face 2*a* of the shower apparatus F1 (body 2). As shown in FIG. 1B, a plurality of nozzle stubs 242 are provided in a bottom face 2*b* opposite the top face 2*a* of the shower apparatus F1. A nozzle hole 243 is formed in each nozzle stub 242. As shown in FIG. 1C, the plurality of nozzle stubs 242 are provided in the bottom face 2*b* of the body 2. According to the present embodiment, seven rows by five columns of nozzle stubs 242 are formed for a total of 35 nozzle stubs.

Figure 2:
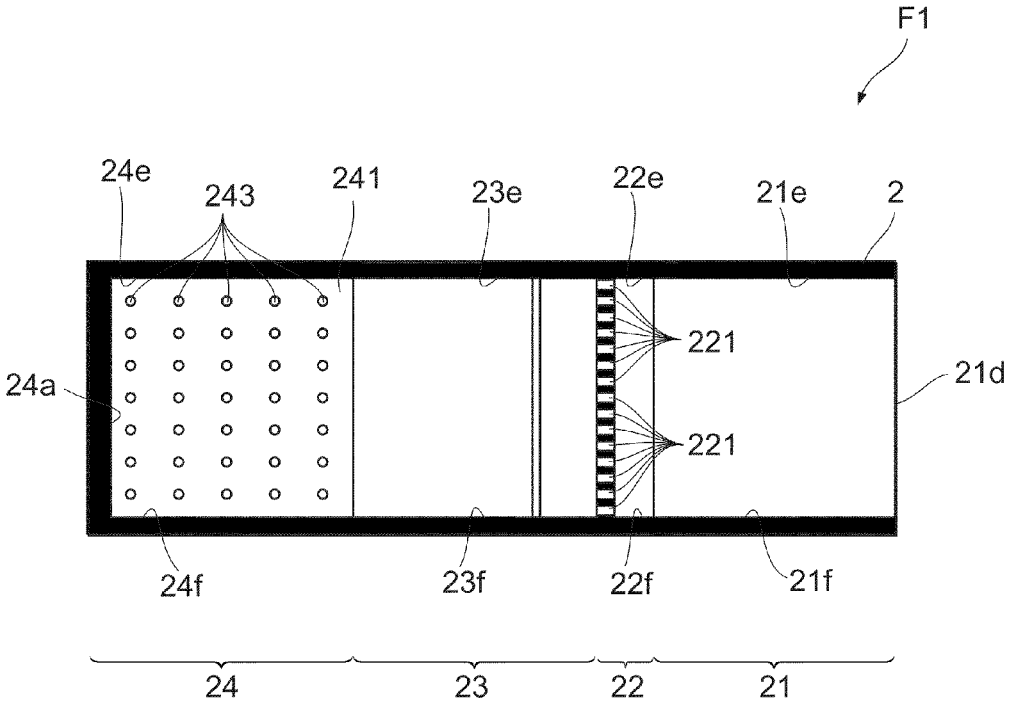
FIG. 2 is a sectional view taken along line A-A in FIG. 1B.

Next, the shower apparatus F1 will be described with reference to FIG. 2, which is a sectional view taken along line A-A in FIG. 1B. As shown in FIG. 2, the shower apparatus F1 includes a water supply unit 21, throttle unit 22, aeration unit 23, and nozzle unit 24.

The water supply unit 21 is a part intended to supply water and adapted to supply water introduced through a water supply port 21*d* to the throttle unit 22. The water supply port 21*d* can be connected with water supply means (such as a water supply hose: not shown) and the water supplied through the water supply means is supplied from the water supply unit 21 to the throttle unit 22. The water supply unit 21 includes a side wall 21*e* and side wall 21*f* both running along the traveling direction of water as part of the body 2 by being placed so as to be parallel to each other.

The throttle unit 22 is a part installed downstream of the water supply unit 21 and adapted to make the cross sectional area of a flow channel smaller than the water supply unit 21 and thereby eject passing water downstream. The throttle unit 22 includes a side wall 22*e* and side wall 22*f* both running along the traveling direction of water as part of the body 2 by being placed so as to be parallel to each other. A plurality of throttle channels 221 are installed in the throttle unit 22. The throttle channels 221 are arranged side by side in a single tier, forming a line along a direction from the side wall 22*e* to the side wall 22*f*.

The aeration unit 23 is a part installed downstream of the throttle unit 22 and provided with the opening 231 used to aerate the water ejected through the throttle unit 22 and thereby turn the water into bubbly water. The aeration unit 23 includes a side wall 23*e* and side wall 23*f*, as part of the body 2, along a traveling direction of water. The side wall 23*e* and side wall 23*f* are placed so as to be parallel to each other.

The nozzle unit 24 is a part installed downstream of the aeration unit 23 and provided with the plurality of nozzle holes 243 used to discharge bubbly water. The nozzle holes 243 are formed in a nozzle member 241 mounted in the body 2. The nozzle stubs 242 are installed on the nozzle member 241 and are exposed externally through holes (not shown clearly in the figure) formed in the body 2.

As shown in FIG. 2, the side wall 21*e* of the water supply unit 21, side wall 22*e* of the throttle unit 22, side wall 23*e* of the aeration unit 23, and side wall 24*e* of the nozzle unit 24 are placed so as to lie in the same plane. Similarly, the side wall 21*f* of the water supply unit 21, side wall 22*f* of the throttle unit 22, side wall 23*f* of the aeration unit 23, and side wall 24*f* of the nozzle unit 24 are placed so as to lie in the same plane.

Figure 3:
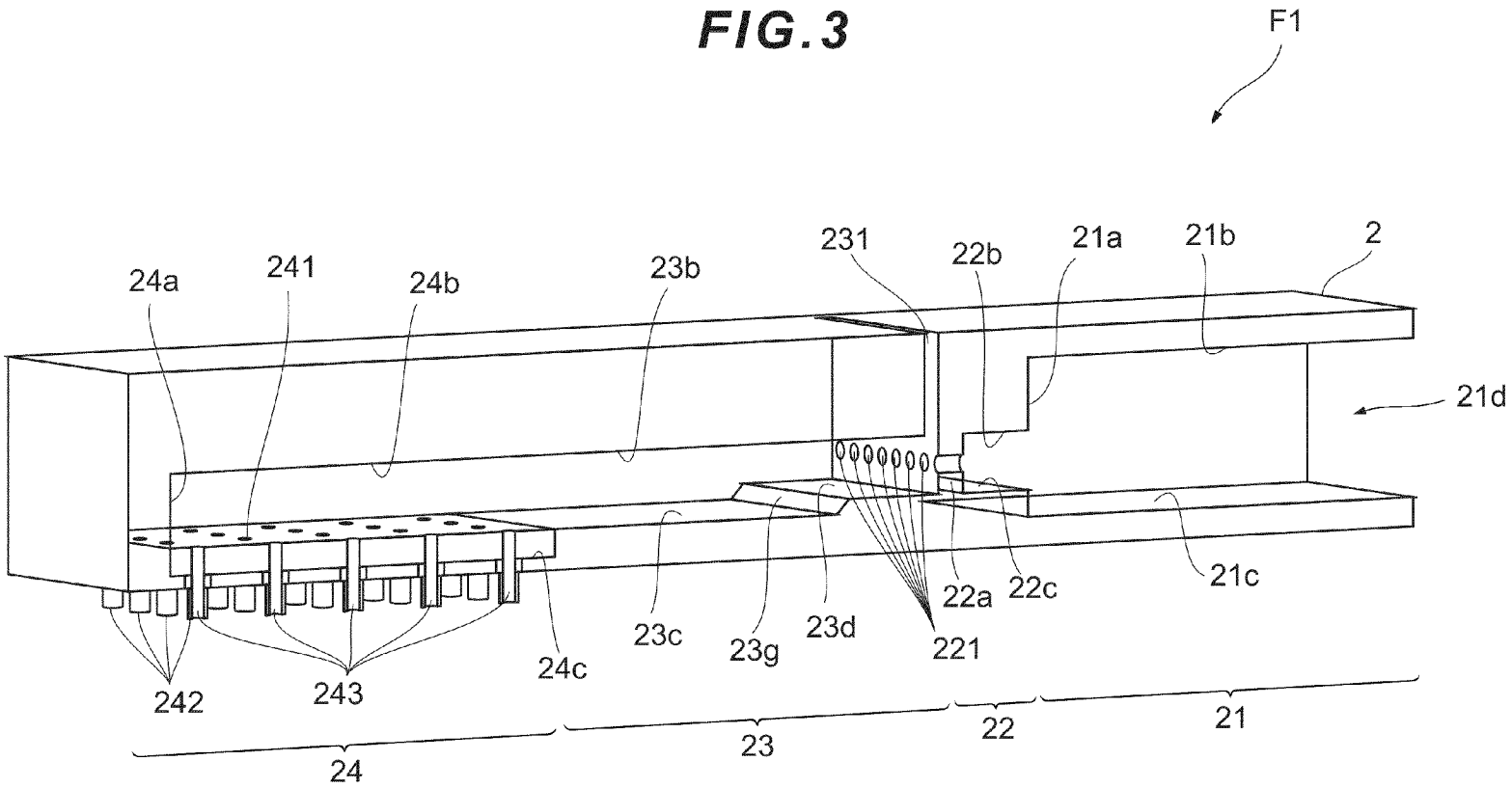
FIG. 3 is a sectional perspective view taken along line B-B in FIG. 1A.

Next, the shower apparatus F1 will be described with reference to FIG. 3, which is a sectional perspective view taken along line B-B in FIG. 1A. As shown in FIG. 3, the water supply unit 21 includes a side wall 21*b* and side wall 21*c* which connect the side wall 21*e* with side wall 21*f*. The side wall 21*b* and side wall 21*c* are formed to be longer in length along a direction orthogonal to the direction in which water proceeds than the side wall 21*e* and side wall 21*f*. Thus, the water supply unit 21 is formed such that the cross section of the flow channel will have a flat shape. A front wall surface 21*a* is installed in a boundary portion between the water supply unit 21 and throttle unit 22, and the side walls 21*e*, 21*f*, 21*b*, and 21*c* are connected to the front wall surface 21*a*. The front wall surface 21*a* is made up of a portion which extends from the side wall 21*b* to the side wall 21*c* and a portion which extends from the side wall 21*c* to the side wall 21*b*.

The throttle unit 22 is installed in a region on the downstream side beyond the front wall surface 21*a*. The throttle unit 22 has a side wall 22*b* and side wall 22*c* which connect the side wall 22*e* and side wall 22*f* with each other. The side wall 22*b* and side wall 22*c* are formed to be longer in length along a direction orthogonal to the direction in which water proceeds than the side wall 22*e* and side wall 22*f*. Thus, the cross section of the flow channel surrounded by the side walls 22*b*, 22*c*, 22*e*, and 22*f* of the throttle unit 22 is formed to have a flat shape. A partition wall 22*a* is installed in a boundary portion between the throttle unit 22 and aeration unit 23, and the side walls 22*e*, 22*f*, 22*b*, and 22*c* are connected to the partition wall 22*a*. A plurality of through-holes are made in the partition wall 22*a*, thereby forming the plurality of throttle channels 221. The throttle channels 221 are placed uniformly in the section of the flow channel on both sides of the partition wall 22*a*.

The aeration unit 23 is installed in a region on the downstream side beyond the partition wall 22*a*. The aeration unit 23 includes a side wall 23*b*, side wall 23*c*, and side wall 23*d*, all of which connects the side wall 23*e* with the side wall 23*f*, where the side wall 23*c* is placed at a location opposite to and relatively distant from the side wall 23*b* while the side wall 23*d* is placed at a location opposite to and relatively close to the side wall 23*b*. The side wall 23*c* is placed on the side of the nozzle unit 24 and the side wall 23*d* is placed on the side of the throttle unit 22. Besides, a stepped portion 23*g* is formed, connecting the side wall 23*c* with the side wall 23*d*. The side walls 23*b*, 23*c*, and 23*d* are formed to be longer in length along a direction orthogonal to the direction in which water proceeds than the side wall 23*e* and side wall 23*f*. Therefore, the aeration unit 23 is formed such that the cross section of the flow channel will have a flat shape.

The nozzle unit 24 is installed in a region downstream of the side wall 23*c*. The nozzle unit 24 includes a side wall 24*b* connecting the side wall 24*e* with the side wall 24*f* and lying in the same plane as the side wall 23*b* of the aeration unit 23. Furthermore, the nozzle unit 24 includes a side wall 24*c* connecting the side wall 24*e* with the side wall 24*f* and lying in a plane recessed below the side wall 23*c* of the aeration unit 23. The side walls 24*b*, 24*c*, 24*e*, and 24*d* are connected to an inner-side side wall 24*a* which faces the water supply port 21*d* and functions as a terminal end of the flow channel. Furthermore, in that part of the body 2 which faces the side wall 24*b*, the nozzle unit 24 includes the nozzle member 241 placed so as to abut the side wall 24*c*. The nozzle member 241 is fitted in a concave portion provided in the body 2, and that face of the nozzle member 241 which opposes the side wall 24*b* lies in the same plane as the side wall 23*c* of the aeration unit 23. The nozzle member 241 has the nozzle stubs 242 as described above and tip portions of the nozzle stubs 242 are mounted on the body 2, protruding from the body 2.

Next, flow of water in the shower apparatus F1 will be described with reference to FIG. 4, which is a simplified sectional view taken along line B-B in FIG. 1A, showing a state of water in the shower apparatus F1 being supplied with water.

Figure 4:
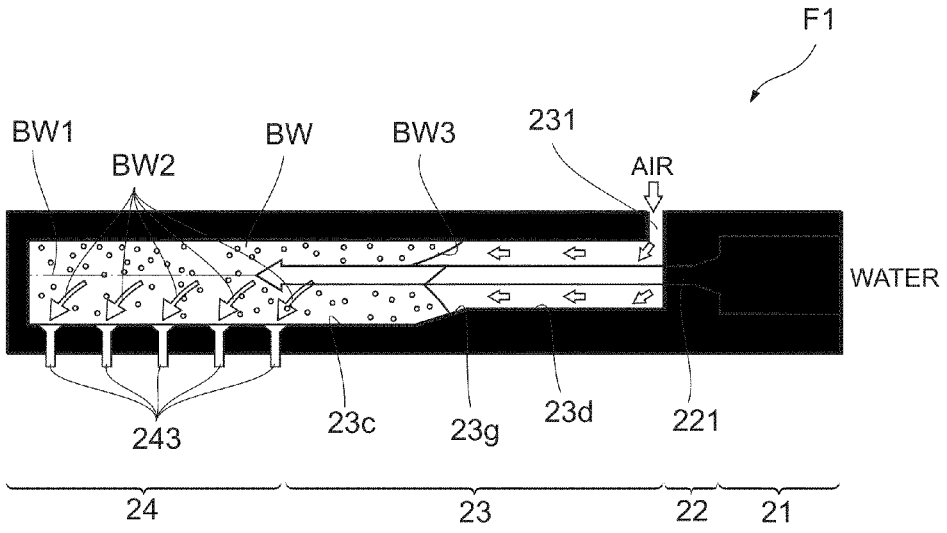
FIG. 4 is a sectional view taken along line B-B in FIG. 1A, showing a flow of water in the shower apparatus.

As shown in FIG. 4, when water is supplied to the water supply unit 21 from water supply means (not shown) at or above a predetermined pressure, the water is ejected downstream through the throttle channel 221 formed in the throttle unit 22. The water is ejected downstream from the throttle channels 221 to the aeration unit 23 and the nozzle unit 24, with a virtual water ejection straight line BW1 of the water extending to the most distant nozzle hole 243 so as to avoid interference with the side walls 23*b*, 23*c*, 23*d*, 23*e*, and 23*f* of the aeration unit 23 and the side walls 24*b*, 24*c*, 24*d*, and 24*e* of the nozzle unit 24. The virtual water ejection straight line BW1 is a virtual straight line obtained by extending the ejection direction of the water ejected through the throttle unit 22.

When water is ejected from the throttle unit 22 in this way, water is temporarily accumulated in at least part of the nozzle unit 24 and aeration unit 23, forming an air-liquid interface BW3, which is an interface between air and the accumulated water. Consequently, the water ejected along the virtual water ejection straight line BW1 plunges into the accumulated water through the air-liquid interface BW3 by involving the air existing in the aeration unit 23 and thereby produces bubbly water BW. The bubbly water BW is divided into water streams BW2 and discharged outside through the nozzle holes 243. Since the opening 231 is formed in the aeration unit 23, air can always be kept supplied even though the water ejected along the virtual water ejection straight line BW1 plunges into the accumulated water through the air-liquid interface BW3 by involving the air existing in the aeration unit 23.

In this way, the first embodiment of the present invention provides the shower apparatus F1 for discharging aerated bubbly water BW, the shower apparatus including: the water supply unit 21 adapted to supply water; the throttle unit 22 installed downstream of the water supply unit 21 and adapted to make the cross sectional area of the flow channel smaller than the water supply unit 21 and thereby eject passing water downstream; the aeration unit 23 installed downstream of the throttle unit 22 and provided with the opening 231 adapted to produce bubbly water BW by aerating the water ejected through the throttle unit 22; and the nozzle unit 24 installed downstream of the aeration unit 23 and provided with the plurality of nozzle holes 243 adapted to discharge the bubbly water BW, wherein a virtual water ejection straight line BW1 obtained by extending the ejection direction of the water ejected through the throttle unit 22 reaches a location where the nozzle holes 243 are formed, without interfering with inner walls (the side walls 23*b*, 23*c*, 23*d*, 23*e*, and 23*f*; side walls 24*b*, 24*c*, 24*e*, and 24*f*; and nozzle member 241) of the aeration unit 23 and the nozzle unit 24, and the water ejected from the throttle unit 22 reaches inlets of the nozzle holes 243 without a traveling direction of the water being changed by the inner walls (the side walls 23*b*, 23*c*, 23*d*, 23*e*, and 23*f*; side walls 24*b*, 24*c*, 24*e*, and 24*f*; and nozzle member 241) of the aeration unit 23 and the nozzle unit 24.

According to the present embodiment, the water supplied from the water supply unit 21 is ejected to the aeration unit 23 and nozzle unit 24 through the throttle unit 22, and the water temporarily pooled in the aeration unit 23 and nozzle unit 24 is discharged outside through the plurality of nozzle holes 243 in the nozzle unit 23. By involving air taken in through the opening 231 formed in the aeration unit 23, the water ejected through the throttle unit 22 plunges into the air-liquid interface BW3 between air and the water temporarily pooled in the aeration unit 23 and nozzle unit 24 and thereby turns into bubbly water BW to be sprayed through the plurality of nozzle holes 243 in the nozzle unit 24.

According to the present embodiment, since the virtual water ejection straight line BW1 obtained by extending the ejection direction of the water ejected from the throttle unit 22 reaches the location where the nozzle holes 243 are formed, without interfering with inner walls of the aeration unit 23 and the nozzle unit 24, the water ejected from the throttle unit 22 reaches the location where the nozzle holes 243 are formed without having its flow disturbed by the inner walls of the aeration unit 23 and nozzle unit 24. That is, the water is ejected from the throttle unit 22 along a nozzle face in which nozzle holes are formed and is discharged from the nozzle holes successively without its flow being stirred.

Figure 5:
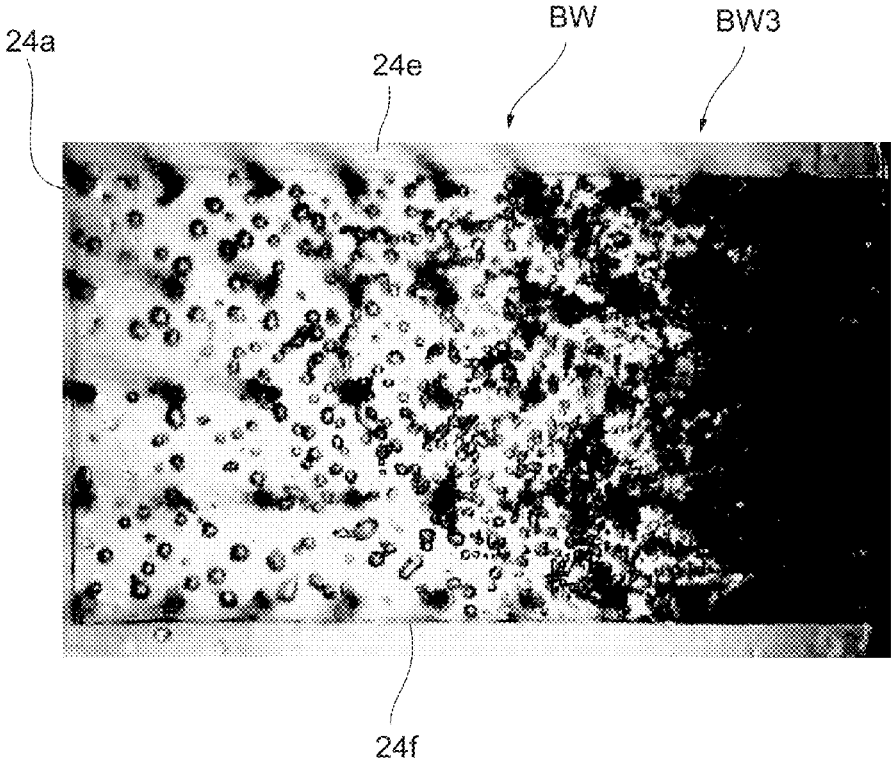
FIG. 5 is a diagram showing how bubbly water is generated in the shower apparatus according to the first embodiment of the present invention.

In a stage in which the water ejected through the throttle unit 22 plunges into the air-liquid interface BW3 and thereby turns into bubbly water BW, the air bubbles in the bubbly water BW can be configured to have a substantially uniform diameter. Thus, the bubbly water BW can reach the location where the nozzle holes 243 are formed while maintaining the substantially uniform diameter. FIG. 5 shows how the bubbly water BW is produced with a substantially uniform bubble diameter maintained.

Figure 6:
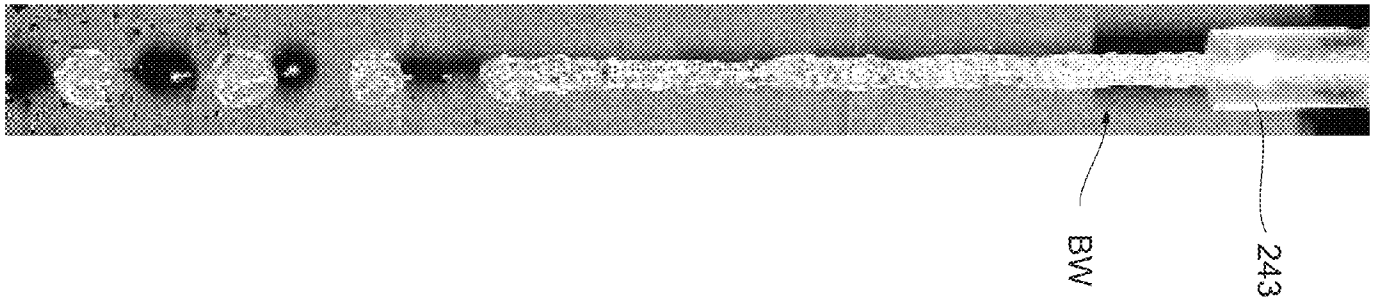
FIG. 6 is a diagram showing an example of how bubbly water is discharged from the shower apparatus according to the first embodiment of the present invention.
Figure 7:
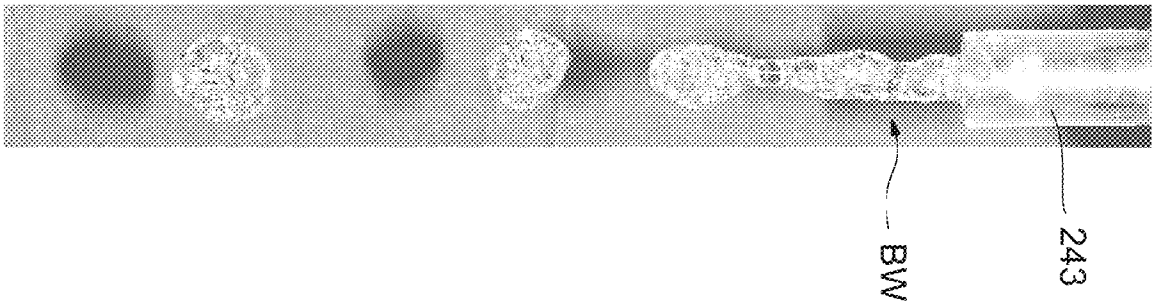
FIG. 7 is a diagram showing an example of how bubbly water is discharged from the shower apparatus according to the first embodiment of the present invention.

As the bubbly water BW containing air bubbles of such a substantially uniform diameter is supplied to the nozzle holes 243, a bubble flow or slug flow can be formed in the nozzle holes 243 or just after discharge from the nozzle holes 243. When discharged from the nozzle holes 243, the bubbly water BW containing air bubbles of such a substantially uniform diameter and formed as a bubble flow or slug flow in this way is finely divided substantially uniformly by being sheared in a direction substantially orthogonal to a discharge direction without being turned into a mist as in the case of an annular flow. FIGS. 6 and 7 show examples of how bubbly water BW is discharged from the nozzle holes 243 with a substantially uniform bubble diameter maintained. In the example shown in FIG. 6, bubbly water BW containing relatively small air bubbles is discharged from the nozzle holes 243 and a bubble flow is formed in the nozzle holes 243 or just after discharge from the nozzle holes 243. In the example shown in FIG. 7, bubbly water BW containing relatively large air bubbles substantially equal to the hole diameter of the nozzle holes 243 is discharged from the nozzle holes 243 and a slug flow is formed in the nozzle holes 243 or just after discharge from the nozzle holes 243.

As shown in FIGS. 6 and 7, the shower apparatus F1 according to the present embodiment can cause water droplets of relatively large, uniform size to land continuously on the user and thereby allow the user to enjoy a shower with a voluminous feel as if the user were showered by large drops of rain.

Also, in the shower apparatus F1 according to the present embodiment, the throttle unit 22 is made up of a plurality of throttle channels 221 arranged side by side. In this way, since the throttle unit 22 is made up of a plurality of throttle channels 221 arranged side by side, the water ejected from the plurality of throttle channels 221 plunges into the air-liquid interface BW3 in parallel, turning the water temporarily pooled in the aeration unit 23 and the nozzle unit 24 into bubbly water BW. Thus, when bubbles are generated from the water ejected from adjacent throttle channels 221, the water streams formed by the plunging water affect each other and tear the bubbles generated by each other, achieving the effect of reducing the bubble diameter of the generated air bubbles. In this way, by feeding the bubbly water containing air bubbles substantially equal and relatively small in diameter into nozzle holes, it is possible to achieve the operation and effect described above, allowing the user to enjoy a more comfortable shower with a voluminous feel as if the user were showered by large drops of rain.

Also, in the shower apparatus F1 according to the present embodiment, a cross section perpendicular to an ejection direction of water ejected from the respective plurality of throttle channels 221 of each of the aeration unit 23 and nozzle unit 24 is formed into a flat shape whose longer sides run along the direction in which the plurality of throttle channels 221 are arranged side by side. In this way, since the cross section of each of the aeration unit 23 and nozzle unit 24 is formed into a flat shape whose longer sides run along the direction (lateral direction) in which the plurality of throttle channels 221 are arranged side by side, the aeration unit 23 and nozzle unit 24 are formed to be narrow in the direction (vertical direction) orthogonal to the direction (lateral direction) in which the plurality of throttle channels 221 are arranged side by side, and wide in the direction (lateral direction) in which the plurality of throttle channels 221 are arranged side by side.

This makes the bubbly water BW resistant to diffusion in the direction (vertical direction) orthogonal to the direction (lateral direction) in which the plurality of throttle channels 221 are arranged side by side, and consequently the air bubbles in the bubbly water BW do not diffuse easily in that direction. Therefore, by expanding the cross sections of the aeration unit 23 and nozzle unit 24 in the direction (lateral direction) in which the plurality of throttle channels 221 are arranged side by side, a plurality of water streams can be caused to affect each other, achieving the effect of tearing the air bubbles. On the other hand, in the direction (vertical direction) orthogonal to the side-by-side arrangement direction, collisions among air bubbles can be reduced, allowing the bubbly water BW to reach the nozzle holes 243 by maintaining more uniform bubble diameter.

Also, in the shower apparatus F1 according to the present embodiment, those side walls (side walls 23*e* and 23*f* and side walls 24*e* and 24*f*) of each of the aeration unit 23 and nozzle unit 24 which face each other across the ejection direction of the water ejected from the throttle unit 22 are placed so as to be parallel to each other. In this way, as the side walls (side walls 23*e* and 23*f* and side walls 24*e* and 24*f*) of each of the aeration unit 23 and nozzle unit 24 are placed so as to be parallel to each other, where the side walls provide flow channels through which the water ejected from the throttle channels 221 pass, straight flow channels are provided for the water ejected from the throttle channels 221 to pass through. This makes it possible to reduce water turbulence produced when the water ejected from the throttle channels 221 plunges into the air-liquid interface BW3 and supply bubbly water BW of uniform bubble diameter to the nozzle holes.

Also, in the shower apparatus F1 according to the present embodiment, the aeration unit 23 includes a side wall 23*b*, side wall 23*c*, and side wall 23*d*, all of which connects the side wall 23*e* with the side wall 23*f*, where the side wall 23*c* is placed at a location opposite to and relatively distant from the side wall 23*b* while the side wall 23*d* is placed at a location opposite to and relatively close to the side wall 23*b*. Also, the side wall 23*c* is placed on the side of the nozzle unit 24 and the side wall 23*d* is placed on the side of the throttle unit 22. Besides, a stepped portion 23*g* is formed, connecting the side wall 23*c* with the side wall 23*d*.

Therefore, an abrupt expansion portion is installed in the aeration unit 23, being formed of the side walls 23*b*, 23*c*, and 23*d* and stepped portion 23*g* and adapted to abruptly expand, along a traveling direction of the water, a cross sectional area orthogonal to the ejection direction of the water ejected from the throttle unit 22. The abrupt expansion portion configured in this way functions as position control means and thereby allows the air-liquid interface BW3 to be placed closer to the nozzle holes 243 than to the stepped portion 23*g*, but closer to the throttle unit 22 than to the first-row nozzle holes formed closest to the throttle unit 22 holes out of the nozzle holes 243.

When the stepped portion 23*g* is formed in this way, although the air-liquid interface BW3, which is formed when the water ejected from the throttle unit 22 is temporarily pooled in the nozzle unit 24, advances from the nozzle unit 24 toward the throttle unit 22, the advance is interrupted by the stepped portion 23*g* of the abrupt expansion portion, making it possible to perform control so as to position the air-liquid interface BW3 reliably between the nozzle unit 24 and throttle unit 22.

Furthermore, according to the present embodiment, the side walls 23*b*, 23*c*, and 23*d* and stepped portion 23*g* which function as the abrupt expansion portion are configured to expand the cross sectional area on the side where the nozzle holes 243 of the nozzle unit 24 are formed. In this way, since the abrupt expansion portion is formed by expanding the cross sectional area on the side where the nozzle holes 243 are formed, after the water ejected from the throttle unit 22 plunges into the air-liquid interface BW3, a flow is generated, moving toward the nozzle holes 243 along the side wall 23*c*, i.e., the wider side of the abrupt expansion portion. This makes it possible to direct the water reliably toward that side of the nozzle unit 23 on which the nozzle holes 243 are formed, and thereby discharge the water reliably through the nozzle holes 243.

Since the abrupt expansion portion made up of the side walls 23*b*, 23*c*, and 23*d* and stepped portion 23*g* in this way and configured as the position control means allows the air-liquid interface BW3 to be positioned closer to the throttle unit 22 than to the first-row nozzle holes (the nozzle holes 243 closest to the throttle unit 22), the water ejected through the throttle unit 22 can be decelerated sufficiently by the resistance of the water existing between the air-liquid interface BW3 and first-row nozzle holes. Thus, by simply using the resistance of the water existing between the air-liquid interface BW3 and first-row nozzle holes, the water plunging into the air-liquid interface BW3 can be decelerated before the water reaches the first-row nozzle holes, so as to be able to be discharged through the first-row nozzle holes. Consequently, the bubbly water can be discharged stably and evenly through all the nozzle holes.

From the viewpoint of controlling the position of the air-liquid interface BW3 in this way, in the shower apparatus F1 according to the present embodiment, a plurality of throttle channels 221 are placed in parallel in the throttle unit 22. This configuration causes the water ejected from the plurality of throttle channels 221 to plunge into the air-liquid interface BW3 in parallel streams. Therefore, the forces exerted by the ejected water can be transmitted evenly to all over the air-liquid interface BW3, making it possible to stably position the air-liquid interface BW3 closer to the throttle unit 22 than to the first-row nozzle holes. Consequently, the water can more stably be discharged evenly through all the nozzle holes 243.

Figure 8A:
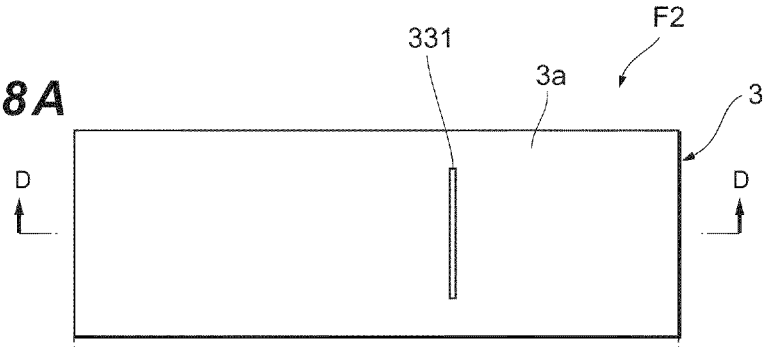
FIGS. 8A to 8C are diagrams showing a shower apparatus according to a second embodiment of the present invention, where
Figure 8B:
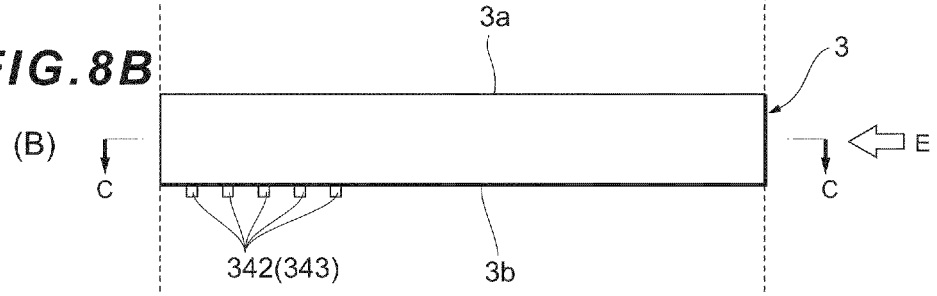
Figure 8C:
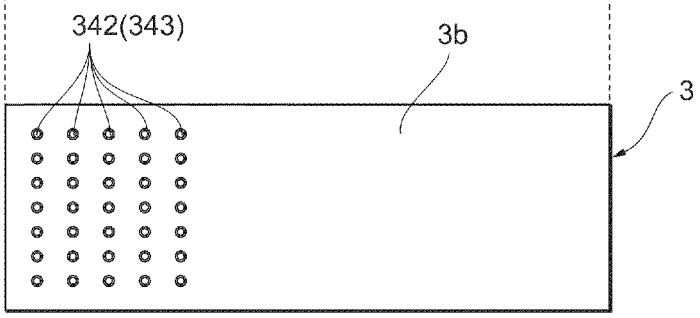

Next, a shower apparatus according to a second embodiment of the present invention will be described with reference to FIGS. 8A to 8C, which are diagrams showing the shower apparatus F2 according to the first embodiment of the present invention, where FIG. 8A is a plan view, FIG. 8B is a side view, and FIG. 8C is a bottom view. As shown in FIG. 8A, the shower apparatus F2 mainly includes a body 3 shaped as an approximately rectangular parallelepiped, and an opening 331 is formed in a top face 3*a* of the shower apparatus F2 (body 3). As shown in FIG. 8B, a plurality of nozzle stubs 342 are provided in a bottom face 3*b* opposite the top face 3*a* of the shower apparatus F2. A nozzle hole 343 is formed in each nozzle stub 342. As shown in FIG. 8C, the plurality of nozzle stubs 342 are provided in the bottom face 3*b* of the body 3. According to the present embodiment, seven rows by five columns of nozzle stubs 342 are formed for a total of 35 nozzle stubs.

Figure 9:
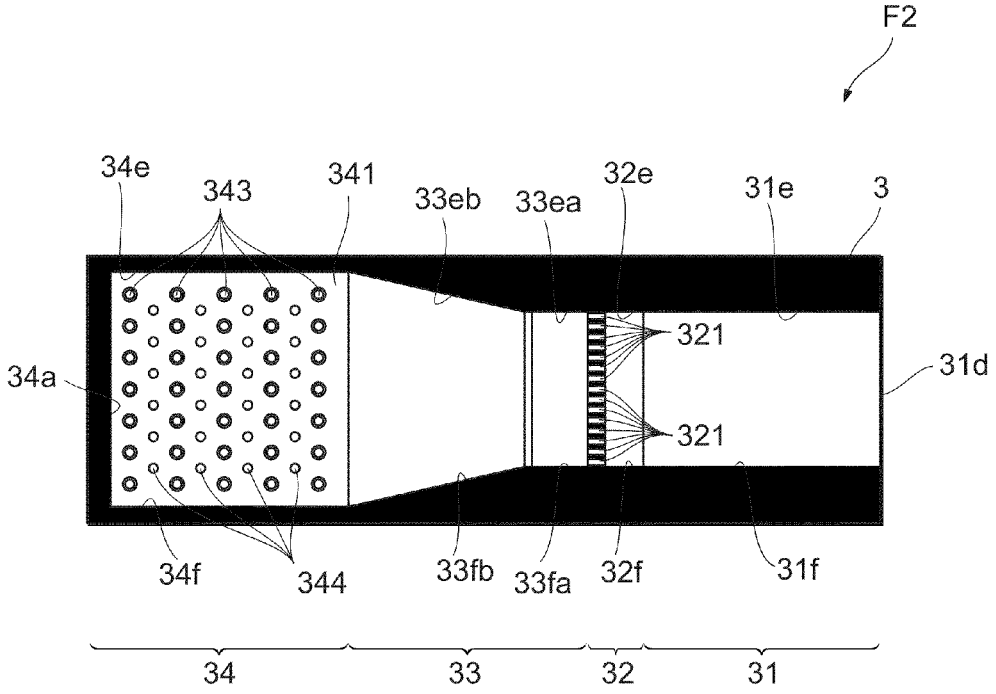
FIG. 9 is a sectional view taken along line C-C in FIG. 8B.

Next, the shower apparatus F2 will be described with reference to FIG. 9, which is a sectional view taken along line C-C in FIG. 1B. As shown in FIG. 9, the shower apparatus F2 includes a water supply unit 31, throttle unit 32, aeration unit 33, and nozzle unit 34.

The water supply unit 31 is a part intended to supply water and adapted to supply water introduced through a water supply port 31*d* to the throttle unit 32. The water supply port 31*d* can be connected with water supply means (such as a water supply hose: not shown) and the water supplied through the water supply means is supplied from the water supply unit 31 to the throttle unit 32. The water supply unit 31 includes a side wall 31*e* and side wall 31*f* both running along the traveling direction of water as part of the body 3 by being placed so as to be parallel to each other.

Figure 11:
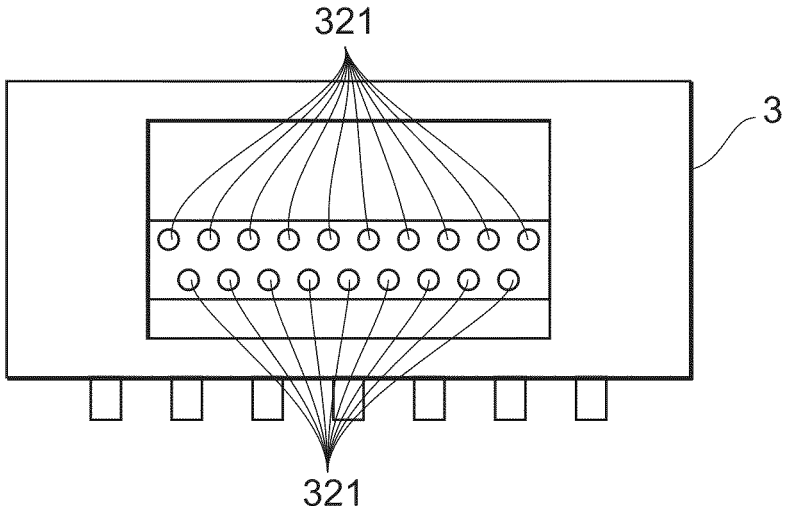
FIG. 11 is a view taken in the direction of arrow E in FIG. 8B.

The throttle unit 32 is a part installed downstream of the water supply unit 31 and adapted to make the cross sectional area of a flow channel smaller than the water supply unit 31 and thereby eject passing water downstream. The throttle unit 32 includes a side wall 32*e* and side wall 32*f* both running along the traveling direction of water as part of the body 3 by being placed so as to be parallel to each other. A plurality of throttle channels 321 are installed in the throttle unit 32. The throttle channels 321 are arranged side by side in two tiers along a direction from the side wall 32*e* to the side wall 32*f*. A view of how the throttle channels 321 are arranged is shown in FIG. 11, which is a view taken in the direction of arrow E in FIG. 8B. As shown in FIG. 11, ten throttle channels 321 are lined up in the upper tier and nine throttle channels 321 are lined up in the lower tier. The throttle channels 321 in the lower tier are arranged so as to be positioned between the throttle channels 321 in the upper tier, and the throttle channels 321 in the upper tier and the throttle channels 321 in the lower tier are arranged alternately such that each throttle channel 321 in one tier will be placed at substantially equal distance to the closest throttle channels 321 in the other tier. In other words, the plurality of throttle channels 321 arranged side by side are placed alternately in the plurality of tiers, i.e., upper and lower tiers, such that each throttle channel 321 will be placed at an equal distance to the respective pair of throttle channels 321 installed in the adjacent tier.

Returning to FIG. 9, description of other parts will be continued. The aeration unit 33 is a part installed downstream of the throttle unit 32 and provided with the opening 331 used to aerate the water ejected through the throttle unit 32 and thereby turn the water into bubbly water. The aeration unit 33 includes side walls 33*ea* and 33*eb* and side walls 33*fa* and 33*fb* installed along a traveling direction of water as part of the body 3. The side wall 33*ea* and side wall 33*fa* are placed so as to be parallel to each other. The side wall 33*eb* is installed downstream of the side wall 33*ea* consecutively with the side wall 33*ea* and placed obliquely so as to expand the flow channel outward from a portion connected to the side wall 33*ea* as the flow channel goes downstream. Similarly, the side wall 33*fb* is installed downstream of the side wall 33*fa* consecutively with the side wall 33*fa* and placed obliquely so as to expand the flow channel outward from a portion connected to the side wall 33*fa* as the flow channel goes downstream.

The nozzle unit 34 is a part installed downstream of the aeration unit 33 and provided with the plurality of nozzle holes 343 used to discharge bubbly water. The nozzle holes 343 are formed in a nozzle member 341 mounted in the body 3. The nozzle stubs 342 are installed on the nozzle member 341 and are exposed externally through holes (not shown clearly in the figure) formed in the body 3. Furthermore, rod-shaped projections 344 are installed in the nozzle unit 34 to function as eddy reduction means adapted to reduce eddies generated in the nozzle unit. The rod-shaped projections 344 are arranged dispersed among the nozzle holes 343, being spaced in such a way as to be at equal distance from adjacent nozzle holes 343. The relationship between the nozzle holes 343 and rod-shaped projections 344 will be described later.

As shown in FIG. 9, the side wall 31*e* of the water supply unit 31, side wall 32*e* of the throttle unit 32, and side wall 33*ea* which makes up part of the aeration unit 33 are placed so as to lie in the same plane. Another side wall of the aeration unit 33, i.e., the side wall 33*eb*, is placed obliquely, being oriented towards an outer side face of the body 3, and is connected to a side wall 34*e* of the nozzle unit 34. Similarly, the side wall 31*f* of the water supply unit 31, side wall 32*f* of the throttle unit 32, and side wall 33*fa* which makes up part of the aeration unit 33 are placed so as to lie in the same plane. Another side wall of the aeration unit 33, i.e., the side wall 33*fb*, is placed obliquely, being oriented towards an outer side face of the body 3, and is connected to a side wall 34*f* of the nozzle unit 34.

Figure 10:
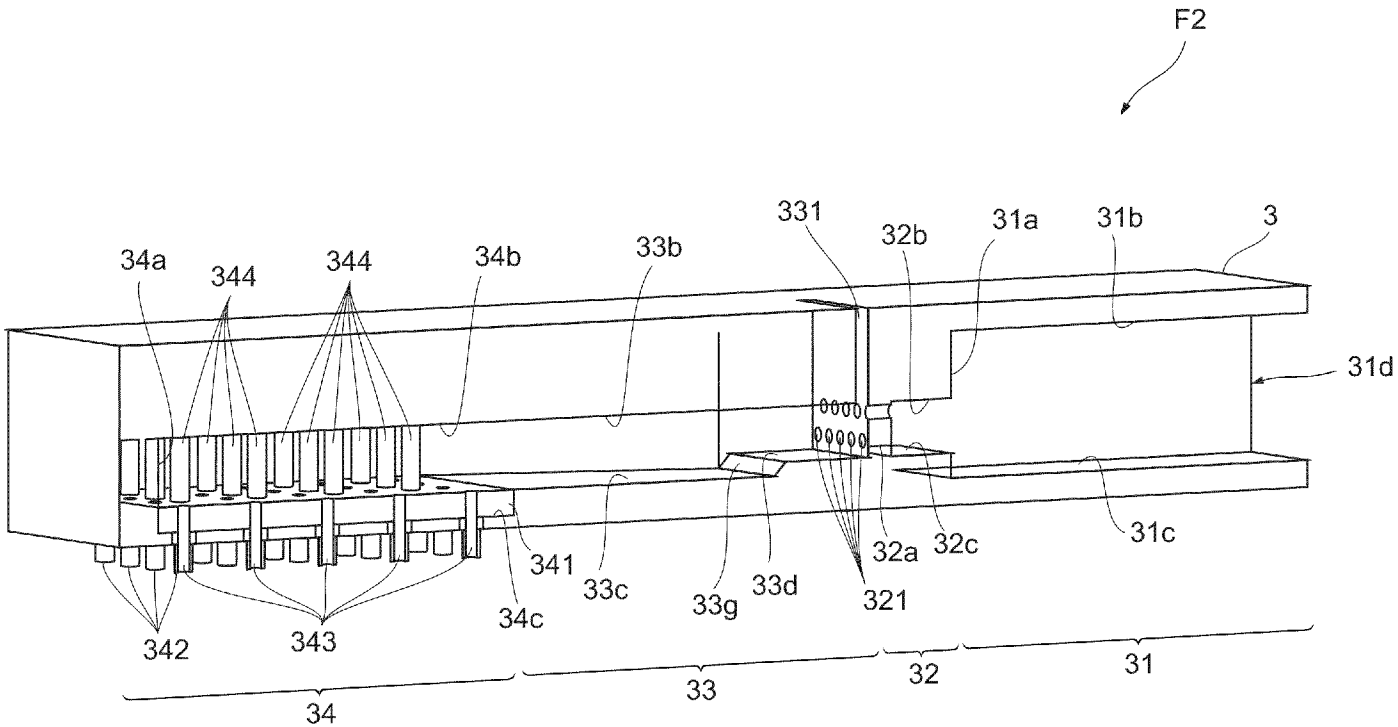
FIG. 10 is a sectional perspective view taken along line D-D in FIG. 8A.

Next, the shower apparatus F2 will be described with reference to FIG. 10, which is a sectional perspective view taken along line D-D in FIG. 8A. As shown in FIG. 10, the water supply unit 31 has a side wall 31*b* and side wall 31*c* which connect the side wall 31*e* and side wall 31*f* with each other. The side wall 31*b* and side wall 31*c* are formed to be longer in length along a direction orthogonal to the direction in which water proceeds than the side wall 31*e* and side wall 31*f*. Thus, the water supply unit 31 is formed such that the cross section of the flow channel will have a flat shape. A front wall surface 31*a* is installed in a boundary portion between the water supply unit 31 and throttle unit 32, and the side walls 31*e*, 31*f*, 31*b*, and 31*c* are connected to the front wall surface 31*a*. The front wall surface 31*a* is made up of a portion which extends from the side wall 31*b* to the side wall 31*c* and a portion which extends from the side wall 31*c* to the side wall 31*b*.

The throttle unit 32 is installed in a region on the downstream side beyond the front wall surface 31*a*. The throttle unit 32 has a side wall 32*b* and side wall 32*c* which connect the side wall 32*e* and side wall 32*f* with each other. The side wall 32*b* and side wall 32*c* are formed to be longer in length along a direction orthogonal to the direction in which water proceeds than the side wall 32*e* and side wall 32*f*. Thus, the cross section of the flow channel surrounded by the side walls 32*b*, 32*c*, 32*e*, and 32*f* of the throttle unit 32 is formed to have a flat shape. A partition wall 32*a* is installed in a boundary portion between the throttle unit 32 and aeration unit 33, and the side walls 32*e*, 32*f*, 32*b*, and 32*c* are connected to the partition wall 32*a*. A plurality of through-holes are made in the partition wall 32*a*, thereby forming the plurality of throttle channels 321.

The aeration unit 33 is installed in a region on the downstream side beyond the partition wall 32*a*. The aeration unit 33 includes a side wall 33*b*, side wall 33*c*, and side wall 33*d*, all of which connect the side walls 33*ea* and 33*eb* with the side walls 33*fa* and 33*fb*, where the side wall 33*c* is placed at a location opposite to and relatively distant from the side wall 33*b* while the side wall 33*d* is placed at a location opposite to and relatively close to the side wall 33*b*. The side wall 33*c* is placed on the side of the nozzle unit 34 while the side wall 33*d* is placed on the side of the throttle unit 32. Besides, a stepped portion 33*g* is formed, connecting the side wall 33*c* with the side wall 33*d*. The side walls 33*b*, 33*c*, and 33*d* are formed to be longer in length along a direction orthogonal to the direction in which water proceeds than the side walls 33*ea* and 33*eb* and side walls 33*fa* and 33*fb*. Therefore, the aeration unit 33 is formed such that the cross section of the flow channel will have a flat shape.

The nozzle unit 34 is installed in a region downstream of the side wall 33*c*. The nozzle unit 34 includes a side wall 34*b* connecting the side wall 34*e* with the side wall 34*f* and lying in the same plane as the side wall 33*b* of the aeration unit 33. Furthermore, the nozzle unit 34 includes a side wall 34*c* connecting the side wall 34*e* with the side wall 34*f* and lying in a plane recessed one step below the side wall 33*c* of the aeration unit 33. The side walls 34*b*, 34*c*, 34*e*, and 34*f* are connected to an inner-side side wall 34*a* which faces the water supply port 31*d* and functions as a terminal end of the flow channel. Furthermore, in that part of the body 3 which faces the side wall 34*b*, the nozzle unit 34 includes the nozzle member 341 placed so as to abut the side wall 34*c*. The nozzle member 341 is fitted in a concave portion provided in the body 3, and that face of the nozzle member 341 which opposes the side wall 34*b* lies in the same plane as the side wall 33*c* of the aeration unit 33. The nozzle member 341 has the nozzle stubs 342 as described above and tip portions of the nozzle stubs 342 are mounted on the body 3, protruding from the body 3.

Furthermore, the rod-shaped projections 344 are installed in the nozzle unit 34 to function as eddy reduction means adapted to reduce eddies generated in the nozzle unit 34. The rod-shaped projections 344 are arranged, being spaced in such a way as to be at equal distance from adjacent nozzle holes 343. The relationship between the nozzle holes 343 and rod-shaped projections 344 will be described with reference to FIG. 12, which is an enlarged sectional view of the nozzle unit 34.

Figure 12:
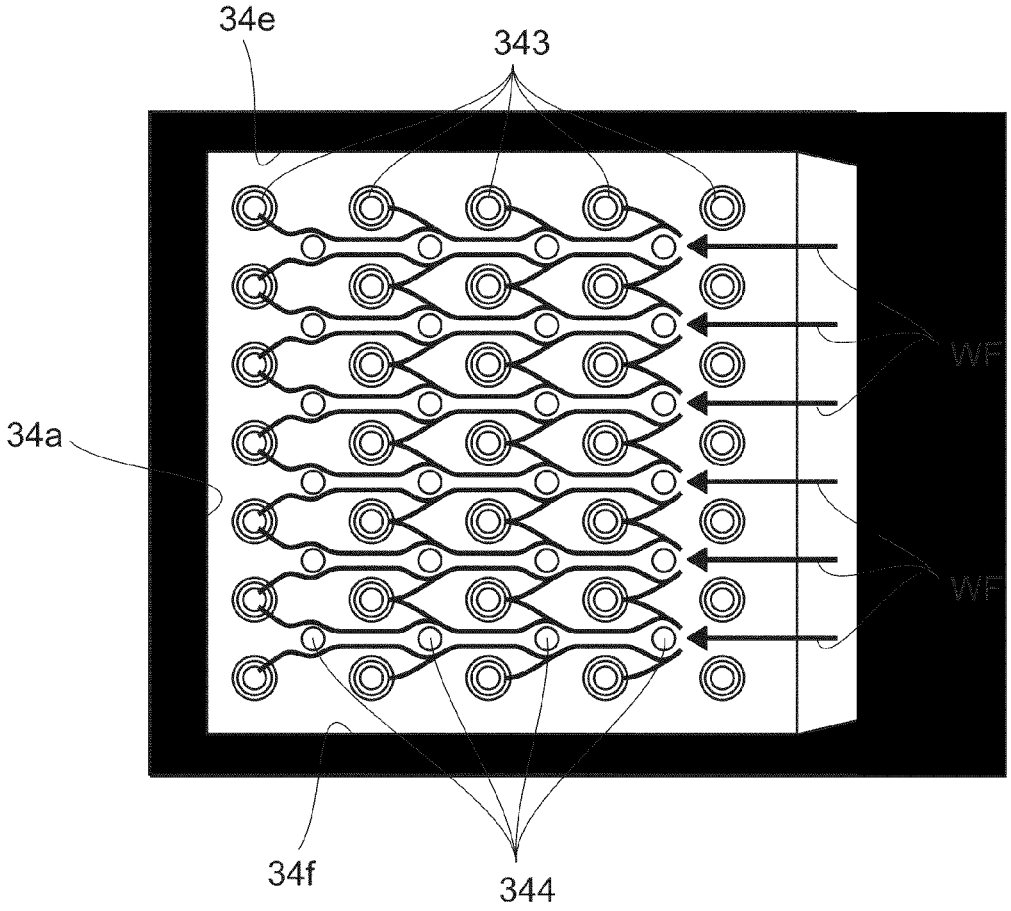
FIG. 12 is an enlarged sectional view of a nozzle unit shown in FIG. 9.

As shown in FIG. 12, when viewed in the traveling direction of a water stream WF flowing in the nozzle unit 34, a line of the rod-shaped projections 344 with a circular cross section is placed between every line of the nozzle holes 343. Also, when viewed in a direction orthogonal to the traveling direction of the water stream WF, a line of the rod-shaped projections 344 with a circular cross section is placed between every line of the nozzle holes 343. Therefore, four nozzle holes 343 adjacent to each rod-shaped projection 344 are placed at equal distances from each other.

Figure 13:
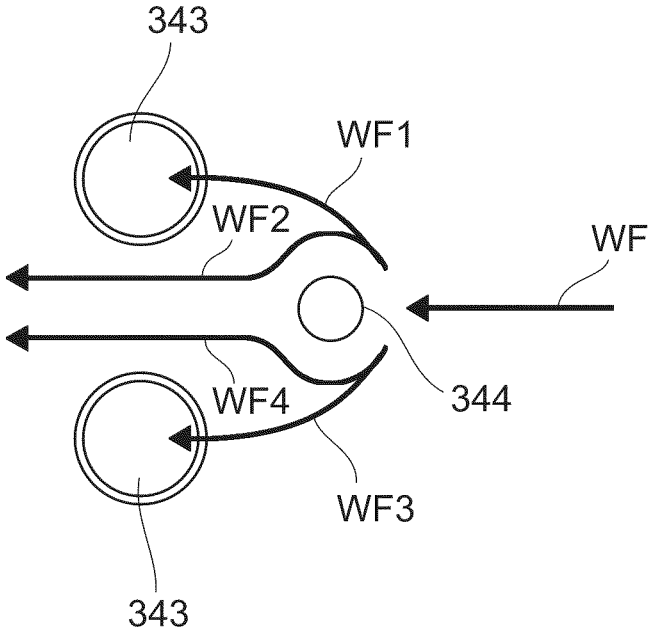
FIG. 13 is a sectional view showing one rod-shaped projection and its vicinity by further enlarging the sectional view of FIG. 12.

A state of how the water stream WF flowing in the nozzle unit 34 is divided by the rod-shaped projections 344 will be described with reference to FIG. 13, which is an enlarged view of one rod-shaped projection 344 of the nozzle unit 34 and its vicinity. As shown in FIG. 13, the water stream WF hitting the rod-shaped projection 344 is divided into a pair of substreams WF1 and WF1 and a pair of substreams WF2 and WF2. The substreams WF1 and WF3 head toward the closest nozzle holes 343 located downstream of the rod-shaped projection 344 and subsequently discharged through the nozzle holes 343. On the other hand, the substreams WF2 and WF4 flow round the rod-shaped projection 344, reunite behind the rod-shaped projection 344, and flow toward another rod-shaped projection 344 further ahead.

In this way, the second embodiment of the present invention provides the shower apparatus F2 for discharging aerated bubbly water, the shower apparatus including: the water supply unit 31 adapted to supply water; the throttle unit 32 installed downstream of the water supply unit 31 and adapted to make the cross sectional area of the flow channel smaller than the water supply unit 31 and thereby eject passing water downstream; the aeration unit 33 installed downstream of the throttle unit 32 and provided with the opening 331 adapted to produce bubbly water by aerating the water ejected through the throttle unit 32; and the nozzle unit 34 installed downstream of the aeration unit 33 and provided with the plurality of nozzle holes 343 adapted to discharge the bubbly water, wherein a virtual water ejection straight line obtained by extending the ejection direction of the water ejected through the throttle unit 32 reaches a location where the nozzle holes 343 are formed, without interfering with inner walls (the side walls 33*b*, 33*c*, 33*d*, 33*ea*, 33*eb*, 33*fa*, and 33*fb*; side walls 34*b*, 34*c*, 34*e*, and 34*f*; and nozzle member 341) of the aeration unit 33 and the nozzle unit 34. That is, the water is ejected from the throttle unit 32 along a nozzle face in which nozzle holes are formed and is discharged from the nozzle holes successively without its flow being disturbed.

Thus, in addition to the characteristic operation and effects achieved by the shower apparatus F1 according to the first embodiment of the present invention described above, the shower apparatus F2 according to the present embodiment achieves the following characteristic operation and effects.

In the shower apparatus F2 according to the present embodiment, the throttle unit 32 is made up of a plurality of throttle channels 321 arranged side by side in each of a plurality of tiers (two tiers). In this way, since the plurality of throttle channels 321 are arranged side by side in each of a plurality of tiers (two tiers), each throttle channel 321 is configured to neighbor throttle channels 321 formed in adjacent tiers in addition to throttle channels 321 formed in the same tier. Thus, a larger number of throttle channels 321 are formed next to each other than when a plurality of throttle channels 321 are arranged side by side in a single tier, enhancing interactions among the water streams formed by the water which plunges into the air-liquid interface by being ejected from the throttle channels 321. This enhances the effect of tearing the air bubbles generated by the water streams of each other, and achieves the effect of reducing the bubble diameter of the generated air bubbles more reliably. Furthermore, a plurality of throttle channels 321 are arranged side by side in each of a plurality of tiers. This makes it possible to reduce the lateral width of the cross section of the portion in which the plurality of throttle channels 321 are formed i.e., the length in the direction along which the plurality of throttle channels 321 are arranged side by side. In this way, by reducing the lateral width of the cross-sectional shape of the portion in which the plurality of throttle channels 321 are formed, it is possible to reduce circumferential length of the cross-section of the portion even if the cross sectional area of the throttle channels is the same. Consequently, when the throttle unit 32, aeration unit 33, and nozzle unit 34 are made of separate components, the reliability of surface sealing among the separate components can be improved.

Furthermore, in the shower apparatus F2 according to the present embodiment, the plurality of throttle channels 321 arranged side by side are placed alternately in the plurality of tiers such that each throttle channel 321 will be placed at an equal distance to the respective pair of throttle channels 321 installed in an adjacent tier. In this way, since the throttle channels 321 are arranged regularly such that each throttle channel 321 will be placed at an equal distance to the respective pair of throttle channels 321 installed in the adjacent tier (see FIG. 11), it is possible to maximize the number of throttle channels 321 closest to each throttle channel 321. Consequently, as a larger number of throttle channels 321 are formed closest to each other, it is possible to further enhance the interactions among the water streams formed by the water which plunges into the air-liquid interface by being ejected from the throttle channels 321, further enhance the effect of tearing the air bubbles generated by the water streams of each other, and achieve the effect of reducing the bubble diameter of the generated air bubbles more reliably. As shown in FIG. 11, if there are an odd number of throttle channels, it is desirable to increase the number of throttle channels on the side on which an opening for introduction of air is provided.

This further prevents the water from flowing backward through the opening for introduction of air.

Furthermore, the throttle unit 32, which is made up of the plurality of throttle channels 321 arranged side by side in parallel in each of the plurality of tiers (two tiers), can not only enhance the interactions among the water streams described above, but also function as position control means for controlling the position of the air-liquid interface and deceleration means for decelerating the water before reaching the first-row nozzle holes 343 formed closest to the aeration unit 33 out of the plurality of nozzle holes 343. Specifically, since the throttle unit 32 is made up of the plurality of throttle channels 321 placed in parallel with each other, the water ejected from the plurality of throttle channels 321 plunges into the air-liquid interface in parallel streams. Therefore, the forces exerted by the ejected water can be transmitted evenly to all over the air-liquid interface, making it possible to stably place the air-liquid interface closer to the throttle unit 32 than to the first-row nozzle holes. Consequently, the water can more stably be discharged evenly through all the nozzle holes 343.

Also, in the shower apparatus F2 according to the present embodiment, by working out an ingenious configuration, the aeration unit 33 is caused to function as deceleration means for decelerating the water plunging into the air-liquid interface, before reaching the first-row nozzle holes 343 formed closest to the aeration unit 33 out of the plurality of nozzle holes 343. Specifically, functionality of the deceleration means is implemented by cross sectional area varying means formed in the aeration unit 33 to reduce, on the side of the throttle unit 32, a cross sectional area orthogonal to the ejection direction of the water ejected from the throttle unit 32. In this way, since the functionality of the deceleration means is implemented by cross sectional area varying means formed in the aeration unit 33 to reduce, on the side of the throttle unit 32, the cross sectional area orthogonal to the ejection direction of the water ejected from the throttle unit 32, the narrowed portion can hold back the air-liquid interface, which is formed when the water ejected from the throttle unit 32 is temporarily pooled in the nozzle unit 34, from moving back toward the throttle unit 32. This ensures that the air-liquid interface will be positioned between the throttle unit 32 and the first-row nozzle holes 343 (a general term for the nozzle holes 343 formed closest to the throttle unit 32 out of the plurality of nozzle holes 343) of the nozzle unit 34 and that the water plunging into the air-liquid interface will be decelerated before reaching the first-row nozzle holes 343. Consequently, the water can be discharged reliably through all the nozzle holes 343 including the first-row nozzle holes 343.

Also, with the shower apparatus F2 according to the present embodiment, in the aeration unit 33, the cross sectional area orthogonal to the ejection direction of the water ejected from the throttle unit 32 is varied in a direction along a plane (plane along the side wall 34*c*) in which the nozzle holes 343 of the nozzle unit 34 are formed. With this configuration, when the water plunging into the air-liquid interface is decelerated, the direction of flow corresponds to a direction along the plane in which the nozzle holes 343 are formed rather than a direction intersecting the plane in which the nozzle holes 343 are formed. Consequently, water flow is less liable to occur in the direction intersecting the plane in which the nozzle holes 343 are formed. This causes water to get easily distributed evenly to the nozzle holes 343 formed in the nozzle unit 34, making it difficult for a flow of water not oriented in a water discharge direction to be produced in a region where the first-row nozzle holes 343 are formed. Such a flow of water would jump over the first-row nozzle holes 343. Consequently, the water can be discharged reliably through all the nozzle holes 343 including the first-row nozzle holes 343.

Also, in the shower apparatus F2 according to the present embodiment, the cross sectional area varying means is configured by gradually varying, in the aeration unit 33, the cross sectional area orthogonal to the ejection direction of the water ejected from the throttle unit 32. This configuration causes the water plunging into the air-liquid interface in the aeration unit 33 to flow along side faces which change gradually. This makes it difficult for the flow of water to stagnate, swirl, or otherwise get disturbed after plunging into the air-liquid interface in the aeration unit 33, and thereby allows the water to be discharged reliably through all the nozzle holes 343 including the first-row nozzle holes 343.

Also, in the shower apparatus F2 according to the present embodiment, the rod-shaped projections 344 are installed in the nozzle unit 34 to provide eddy reduction means for reducing eddies generated in the nozzle unit 34 by the water plunging into the air-liquid interface. The rod-shaped projections 344 serving as the eddy reduction means will be described in detail.

The rod-shaped projections 344 are intended to divide the water stream WF generated in the nozzle unit 34 by the water plunging into the air-liquid interface into substreams WF1, WF2, WF3, and WF4 (see FIGS. 12 and 13). The rod-shaped projections 344 configured in this way curb generation of eddies in the nozzle unit 34. More specifically, when the water stream generated in the nozzle unit 34 by the water plunging into the air-liquid interface is divided into substreams, the water stream can be decelerated before reaching the side wall 34*a* which is an inner wall surface in the deep part of the nozzle unit 34. This prevents the water reaching the side wall 34*a* from turning back therefrom, and thereby prevents a rerun stream from generating a large eddy in the nozzle unit 34. This in turn prevents collisions among air bubbles in the nozzle unit 34 reliably and thereby further ensures that the user can enjoy a shower with a voluminous feel as if the user were showered by large drops of rain.

Also, in the shower apparatus F2 according to the present embodiment, the rod-shaped projections 344 and the nozzle holes 343 are arranged so as not to overlap in a heading direction of the water stream WF generated in the nozzle unit 34 by the water plunging into the air-liquid interface, and the water stream generated in the nozzle unit 34 by the water plunging into the air-liquid interface is divided by the rod-shaped projections 344 and the resulting substreams WF1 and WF3 tending to spread in a lateral direction are caught by the nozzle holes 343 and thereby discharged before spreading excessively.

When the water stream WF generated in the nozzle unit 34 by the water plunging into the air-liquid interface is divided into substreams WF1, WF2, WF3, and WF4 using the eddy reduction means made up of the rod-shaped projections 344 projecting into the nozzle unit 34 to curb generation of eddies in the nozzle unit 34 as with the present embodiment, the substreams resulting from the division by the rod-shaped projections 344 will head in a lateral direction with respect to the traveling direction of the original water stream depending on the situation, and the substreams produced by adjacent rod-shaped projections 344 will collide with each other, which in turn could cause air bubbles to collide with each other.

Thus, according to the present embodiment, the rod-shaped projections 344 and the nozzle holes 343 are arranged so as not to overlap in the heading direction of the water stream WF generated in the nozzle unit 34 by the water plunging into the air-liquid interface. This makes it easy for the nozzle holes 343 to catch the substreams WF1 and WF3 produced by the rod-shaped projections 344 and tending to spread in a lateral direction. Consequently, the substreams WF1 and WF3 are discharged before spreading excessively. This reliably prevents not only eddies produced by the return stream, but also collisions among air bubbles in the nozzle unit 34 caused by collisions among substreams and thereby further ensures that the user can enjoy a shower with a voluminous feel as if the user were showered by large drops of rain.

Also, in the shower apparatus F2 according to the present embodiment, a plurality of the rod-shaped projections 344 are scattered in the depth direction of the nozzle unit 34 corresponding to the heading direction of the water stream WF so that the water stream WF generated in the nozzle unit 34 by the water plunging into the air-liquid interface can be divided into substreams WF1, WF2, WF3, and WF4 a plurality of times. This configuration allows the water stream WF generated in the nozzle unit 34 to be decelerated stepwise at a number of separate times, making it possible to avoid collisions of air bubbles feared to occur when the water stream WF generated in the nozzle 34 unit is rapidly decelerated. Thus, the stepwise deceleration makes it possible to curb generation of large eddies due to a return stream as well as to avoid rapid deceleration and thereby reliably prevent collisions among air bubbles in the nozzle unit 34. This further ensures that the user can enjoy a shower with a voluminous feel as if the user were showered by large drops of rain.

Also, in the shower apparatus F2 according to the present embodiment, the rod-shaped projections 344 are configured to allow the substreams WF2 and WF2 to reunite. That is, the rod-shaped projections 344 are configured to be cylindrical in shape with a diameter of 1 to 2 mm, provided with a continuous side face, and formed at intervals of 5 mm. Since the rod-shaped projections 344 are installed in this way, the substreams WF2 and WF2 are configured to get decelerated and reunite while heading in the traveling direction of the original water stream. This reliably prevents the traveling directions of the water streams and substreams from becoming irregular, thereby prevents collisions among the water streams or substreams, and thereby prevents collisions among air bubbles. This further ensures that the user can enjoy a shower with a voluminous feel as if the user were showered by large drops of rain.

Also, in the shower apparatus F2 according to the present embodiment, since the plurality of the rod-shaped projections 344 are installed, being lined up along the heading direction of the water stream WF generated in the nozzle unit 34 by the water plunging into the air-liquid interface, the substreams can be decelerated reliably while maintaining orientation in the traveling direction of the water stream WF. This configuration reliably prevents the traveling directions of the water stream WF and substreams WF1, WF2, WF3, and WF4 from becoming irregular, thereby prevents collisions with other water streams WF or substreams WF1, WF2, WF3, and WF4, and thereby prevents collisions among air bubbles. This further ensures that the user can enjoy a shower with a voluminous feel as if the user were showered by large drops of rain.

Also, in the shower apparatus F2 according to the present embodiment, those side faces of the rod-shaped projections 344 which face the throttle unit 32 are configured to protrude toward the throttle unit 32, i.e., the side faces are configured to be cylindrical. This configuration makes it possible to reduce resistance produced when the water stream WF traveling in the nozzle unit 34 is divided into substreams WF1, WF1, WF2, and WF2 by hitting the rod-shaped projections 344 and thereby prevent collisions among air bubbles. This further ensures that the user can enjoy a shower with a voluminous feel as if the user were showered by large drops of rain.

In this way, being equipped with the rod-shaped projections 344 serving as the eddy reduction means for reducing eddies generated in the nozzle unit by the water plunging into the air-liquid interface, the shower apparatus F2 according to the present embodiment can reduce eddies generated when a stream flowing past the nozzle holes 343 and reaching the side wall 34*a* which is an inner wall surface in deep part of the nozzle unit 34 returns therefrom. As described above, the shower apparatus F2 according to the present embodiment is configured such that after plunging into the air-liquid interface, the flow of water will not be disturbed by the inner walls of the aeration unit 33 and nozzle unit 34 before reaching the nozzle holes 343 on a primary basis and that the water reaching the nozzle holes 343 on a secondary basis will be prevented from swirling when the water stream reaching the side wall 34*a* returns therefrom. This makes it possible to prevent a situation in which eddies generated in the nozzle unit 34 would cause collisions of air bubbles, facilitating growth in bubble diameter and resulting in air bubbles of nonuniform diameter. Consequently, the bubble diameters in the bubbly water supplied to the nozzle holes 343 can be made uniform. In this way, since greater care is taken to suppress bubble growth in the nozzle unit 34, the shower apparatus F2 according to the present embodiment can further ensure that the bubble diameters in the bubbly water supplied to the nozzle holes 343 will be made uniform. This causes water droplets of relatively large, uniform size to land continuously on the user, further ensuring that the user can enjoy a shower with a voluminous feel as if the user were showered by large drops of rain.

With the shower apparatus F1 according to the first embodiment and shower apparatus F2 according to the second embodiment, the body 2 or 3 is shaped as an approximately rectangular parallelepiped and the water ejected by the throttle unit 22 or throttle unit 32 is aligned in one direction. In light of the spirit of the present invention, the embodiment is not limited to the above embodiments, and may have an approximately disk-shaped body to eject water radially from the throttle unit. Such an embodiment will be described as a third embodiment.

Figure 14A:
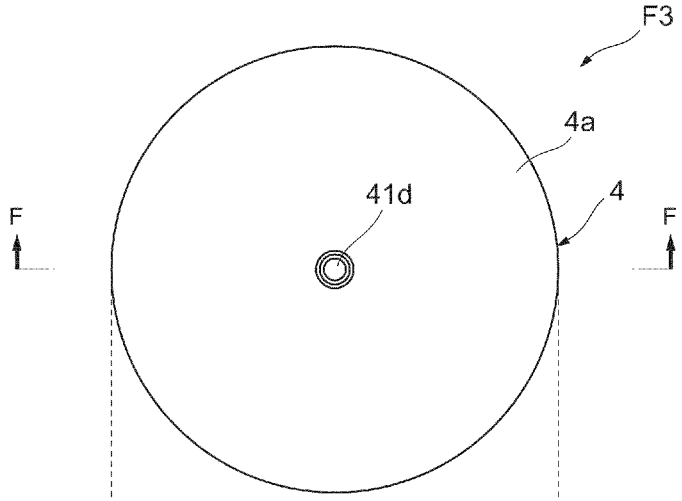
FIGS. 14A to 14C are diagrams showing a shower apparatus according to a third embodiment of the present invention, where
Figure 14B:
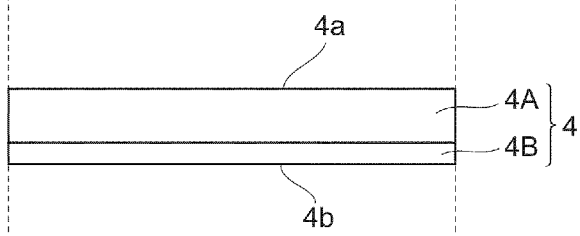
Figure 14C:
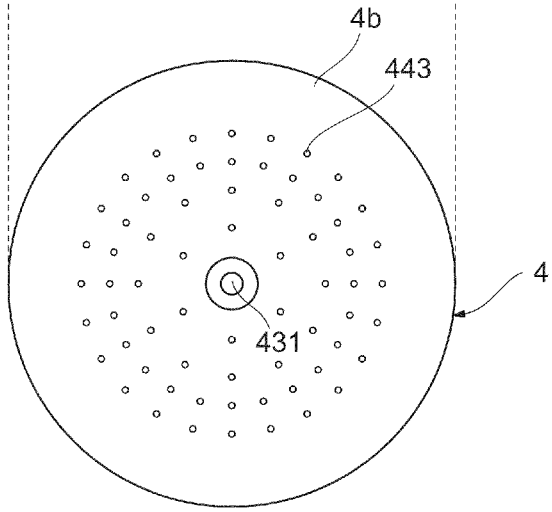

Next, a shower apparatus according to the third embodiment of the present invention will be described with reference to FIGS. 14A to 14C, which are diagrams showing the shower apparatus F3 according to the third embodiment of the present invention, where FIG. 14A is a plan view, FIG. 14B is a side view, and FIG. 14C is a bottom view. As shown in FIG. 14A, the shower apparatus F3 mainly includes a body 4 approximately disk-shaped, and an water supply port 41*d* is formed in a top face 4*a* of the shower apparatus F3 (body 4). As shown in FIG. 14B, the body 4 of the shower apparatus F3 has its external shape formed by a cavity 4A in which the water supply port 41*d* is formed and a shower plate 4B in which nozzle holes 443 are formed. As shown in FIG. 14C, an opening 431 as well as a plurality of nozzle holes 443 are formed in a bottom face 4*b* of the body 4. According to the present embodiment, 66 nozzle holes 443 are formed radially around the opening 431.

Figure 15:
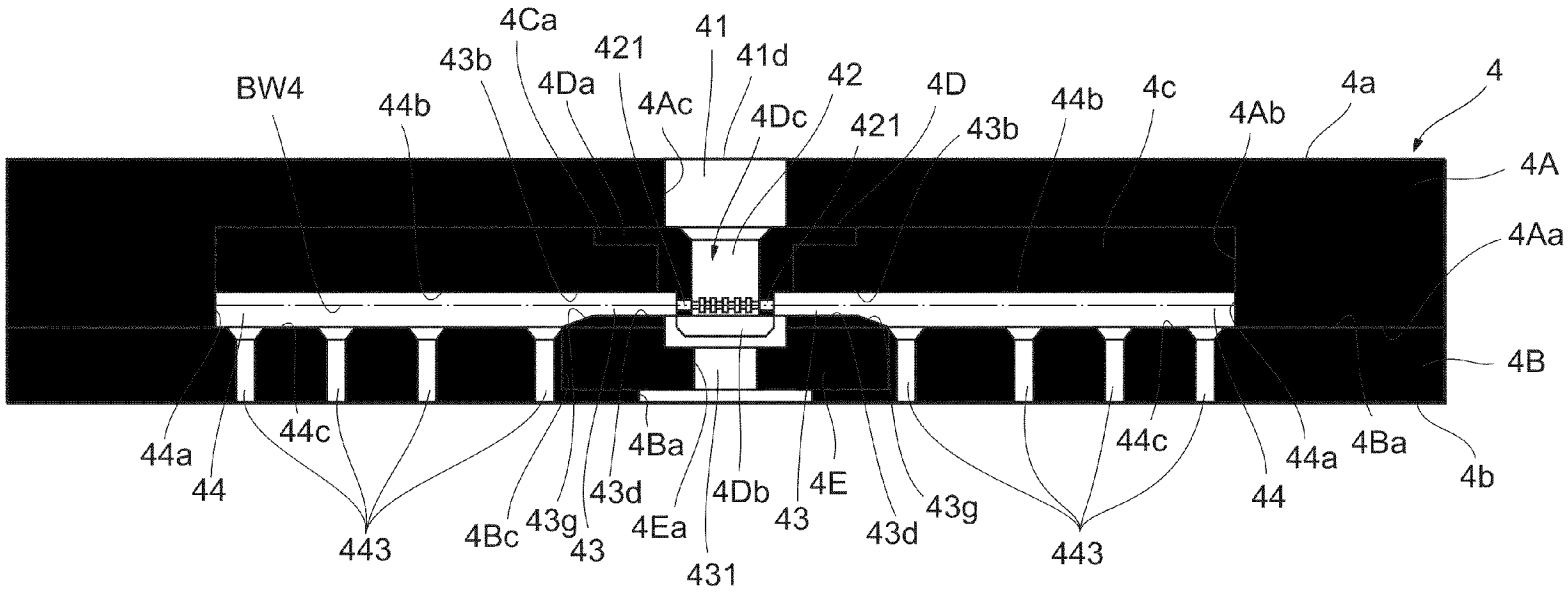
FIG. 15 is a sectional view taken along line F-F in FIG. 14A.

Next, the shower apparatus F3 will be described with reference to FIG. 15, which is a sectional view taken along line F-F in FIG. 14A. As shown in FIG. 15, the shower apparatus F3 includes the cavity 4A, the shower plate 4B, an ejection-piece retaining plate 4C, a water ejection piece 4D, and an air introduction piece 4E.

The cavity 4A is a member which forms the external shape of the body 4 in conjunction with the shower plate 4B. In the cavity 4A, a concave portion 4Ab circular in shape is formed extending from an abutting face 4Aa opposite the top face 4*a* of the body 4 toward the top face 4*a*. The concave portion 4Ab houses the ejection-piece retaining plate 4C which is disk-shaped. A through-hole 4Ca adapted to pass the water ejection piece 4D is formed in the ejection-piece retaining plate 4C. The through-hole 4Ca is a stepped hole, and a flange 4Da of the water ejection piece 4D is held between the stepped portion and the bottom face of the concave portion 4Ab of the cavity 4A.

Figures 16A, 16B, 16C:
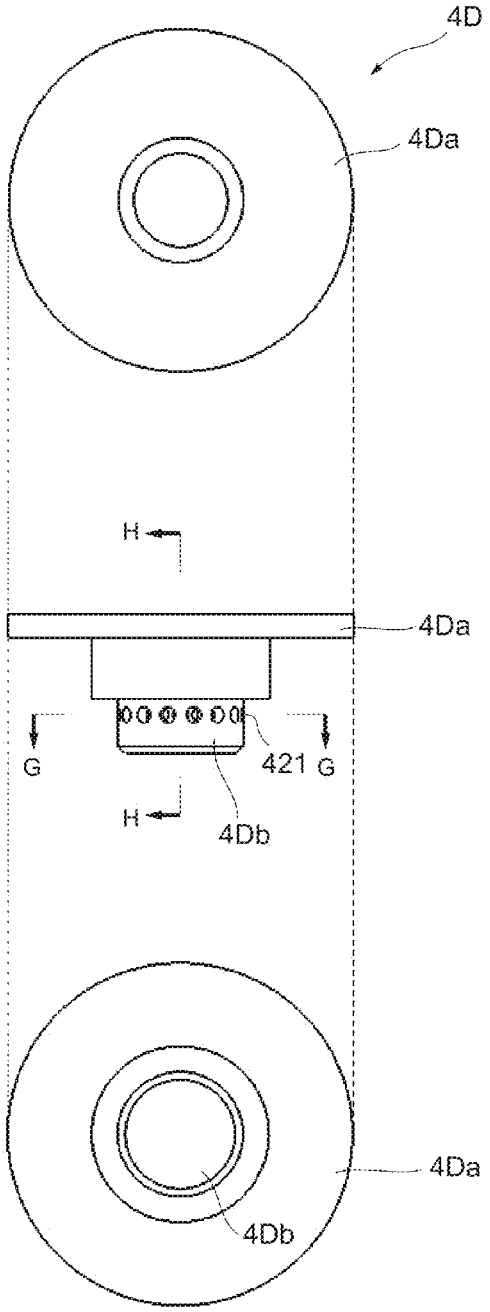
FIGS. 16A to 16C are diagrams showing a water ejection piece shown in FIG. 15, where
Figure 17:
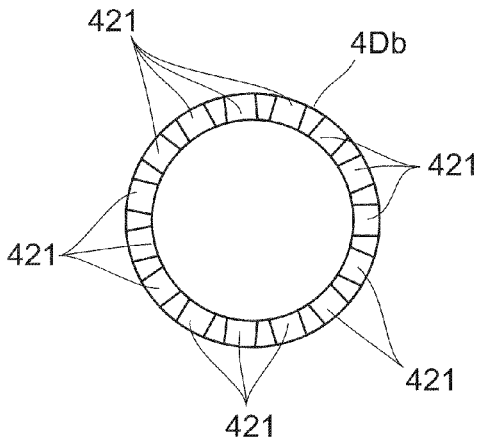
FIG. 17 is a sectional view taken along line G-G in FIG. 15B.
Figure 18:
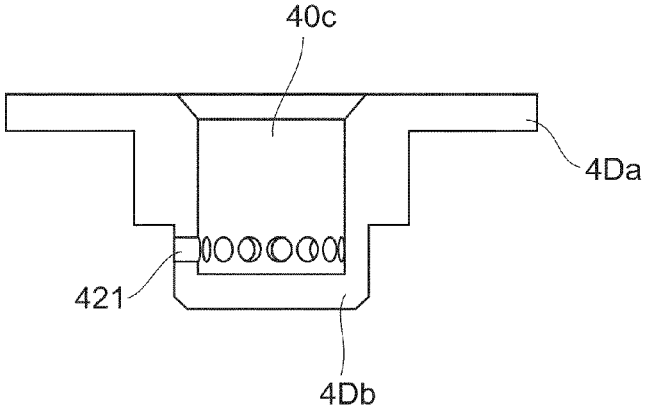
FIG. 18 is a sectional view taken along line H-H in FIG. 15B.

Next, the water ejection piece 4D will be described with reference to FIGS. 16 to 18. FIG. 16 is a three-view drawing of the water ejection piece 4D, where FIG. 16A is a plan view, FIG. 16B is a side view, and FIG. 16C is a bottom view. FIG. 17 is a sectional view taken along line G-G in FIG. 16B. FIG. 18 is a sectional view taken along line H-H in FIG. 16B. As shown in FIGS. 16 and 18, the water ejection piece 4D, with its flange 4Da corresponding to a brim, is shaped like a hat. Also, an ejector projection 4Db is formed at that end of the water ejection piece 4D which, being located opposite the flange 4Da, corresponds to a top of the hat shape. As shown in FIGS. 16 and 17, through-holes are provided radially all around a circumference of the ejector projection 4Db in parallel to a plane of the flange 4Da to serve as throttle channels 421. A recess 4Dc is formed in the water ejection piece 4D, running from the flange 4Da to the throttle channels 421. As the water ejection piece 4D is configured in this way, a throttle unit 42 is formed which includes a path running from the recess 4Dc to the throttle channels 421.

Returning to FIG. 15, the description will be continued. Near the center of the cavity 4A, a through-hole 4Ac is formed, running from the top face 4*a* to the concave portion 4Ab. The through-hole 4Ac is provided, communicating with the recess 4Dc of the water ejection piece 4D. As the through-hole 4Ac is provided in this way, a water supply unit 41 is formed, extending from the water supply port 41*d* to throttle unit 42.

The shower plate 4B is a member which forms the external shape of the body 4 in conjunction with the cavity 4A. The nozzle holes 443 are formed radially in the shower plate 4B. In the region in which the nozzle holes 443 are formed, an abutting face 4Ba is formed, opposing the bottom face 4*b* and making up a side wall 44*c* of a nozzle unit 44. As the abutting face 4Ba of the shower plate 4B and the abutting face 4Aa of the cavity 4A are abutted against each other, a vacant space is formed between the abutting faces and the ejection-piece retaining plate 4C housed in the concave portion 4Ab of the cavity 4A, being configured to serve as an aeration unit 43 and nozzle unit 44. That face of the ejection-piece retaining plate 4C which opposes the shower plate 4B is configured to serve as a side wall 43*b* of the aeration unit 43 and a side wall 44*b* of the nozzle unit 44. Part of the concave portion 4Ab which forms the vacant space in conjunction with the ejection-piece retaining plate 4C housed in the concave portion 4Ab of the cavity 4A is configured to serve as a side wall 44*a* of the nozzle unit 44.

In the shower plate 4B, a concave portion 4Bc circular in shape is formed, extending from the abutting face 4Ba opposite the bottom face 4*b* of the body 4 toward the bottom face 4*b*. The concave portion 4Bc is formed in the center of the shower plate 4B, being located inside the nozzle holes 443 provided radially. A through-hole 4Bb is formed in a bottom face of the concave portion 4Bc, running to the bottom face 4*b*. The air introduction piece 4E is housed in the concave portion 4Bc.

The air introduction piece 4E is an approximately disk-shaped member and a stepped through-hole 4Ea is formed in the center of the air introduction piece 4E. One face of the air introduction piece 4E is a flat circular face which abuts the bottom face of the concave portion 4Bc. A flat circular surface and inclined surface are formed on the other face of the air introduction piece 4E, where the inclined surface is provided by chamfering the circular surface. The flat circular surface makes up a side wall 43*d* of the aeration unit 43 while the inclined surface makes up a stepped portion 43*g* of the aeration unit 43. Only a tip of the ejector projection 4Db of the water ejection piece 4D is inserted through that open end of the through-hole 4Ea which has a large opening area, and the ejector projection 4Db is placed such that the water ejected from the throttle channels 421 in the ejector projection 4Db will not interfere with the side wall 43*d* of the air introduction piece 4E. A gap is formed between the through-hole 4Ea of the air introduction piece 4E and the water ejection piece 4D, and the part running from the gap to the through-hole 4Bb makes up an opening 431 for air introduction.

As described above, when the cavity 4A, the shower plate 4B, ejection-piece retaining plate 4C, water ejection piece 4D, and air introduction piece 4E are assembled, the shower apparatus F3 is configured to include the water supply unit 41, throttle unit 42, aeration unit 43, and nozzle unit 44.

The water supply unit 41 is a part intended to supply water and adapted to supply water introduced through the water supply port 41*d* to the throttle unit 42. The water supply port 41*d* can be connected with water supply means (such as a water supply hose: not shown) and the water supplied through the water supply means is supplied from the water supply unit 41 to the throttle unit 42.

The throttle unit 42 is a part installed downstream of the water supply unit 41 and adapted to make the cross sectional area of a flow channel smaller than the water supply unit 41 and thereby eject passing water downstream. A plurality of throttle channels 421 are installed in the throttle unit 42.

The aeration unit 43 is a part installed downstream of the throttle unit 42 and provided with the opening 431 used to aerate the water ejected through the throttle unit 42 and thereby turn the water into bubbly water.

The nozzle unit 44 is a part installed downstream of the aeration unit 43 and provided with the plurality of nozzle holes 443 used to discharge bubbly water.

In this way, the third embodiment of the present invention provides the shower apparatus F3 for discharging aerated bubbly water, the shower apparatus including: the water supply unit 41 adapted to supply water; the throttle unit 42 installed downstream of the water supply unit 41 and adapted to make the cross sectional area of the flow channel smaller than the water supply unit 41 and thereby eject passing water downstream; the aeration unit 43 installed downstream of the throttle unit 42 and provided with the opening 431 adapted to produce bubbly water by aerating the water ejected through the throttle unit 42; and the nozzle unit 44 installed downstream of the aeration unit 43 and provided with the plurality of nozzle holes 443 adapted to discharge the bubbly water, wherein a virtual water ejection straight line BW4 obtained by extending the ejection direction of the water ejected through the throttle unit 42 reaches a location where the nozzle holes 443 are formed, without interfering with inner walls (the side walls 43*b* and 43*d*; stepped portion 43*g*; and side walls 44*b* and 44*c*) of the aeration unit 43 and the nozzle unit 44. That is, the water is ejected from the throttle unit 42 along a nozzle face in which nozzle holes are formed and is discharged from the nozzle holes successively without its flow being disturbed.

Thus, in addition to the characteristic operation and effects achieved by the shower apparatus F1 according to the first embodiment of the present invention, the shower apparatus F3 according to the present embodiment achieves the following characteristic operation and effects.

In the shower apparatus F3 according to the present embodiment, the throttle unit 42 is made up of a plurality of throttle channels 421 arranged radially, and each of a plurality of the virtual water ejection straight lines BW4 obtained by extending the ejection direction of the water ejected from each of the plurality of throttle channels 421 reaches the location where the nozzle holes 443 are formed, without interfering with inner walls (inner walls 43*b* and 43*d*; stepped portion 43*g*; and side walls 44*b* and 44*c*) of the aeration unit 43 and the nozzle unit 44.

With this configuration, the water ejected from the throttle unit 42 reaches the location where the nozzle holes 443 are formed without having its flow disturbed by the inner walls of the aeration unit 43 and nozzle unit 44. This causes water droplets of relatively large, uniform size to land continuously on the user and thereby allows the user to enjoy a shower with a voluminous feel as if the user were showered by large drops of rain. Furthermore, since the plurality of throttle channels 421 of the throttle unit 42 are arranged radially, the cross sectional area of the flow channel for the water ejected from the plurality of throttle channels 421 become larger in the direction of flow. This makes interference among water streams less liable to occur when the water ejected from the plurality of throttle channels 421 plunges into the air-liquid interface and thereby allows the bubbly water containing air bubbles of a substantially uniform diameter to be supplied to the nozzle holes. Also, as the cross sectional area of the flow channel is made larger, the water plunging into the air-liquid interface can be moderately decelerated and discharged reliably through all the nozzle holes 343.

Figure 19A:
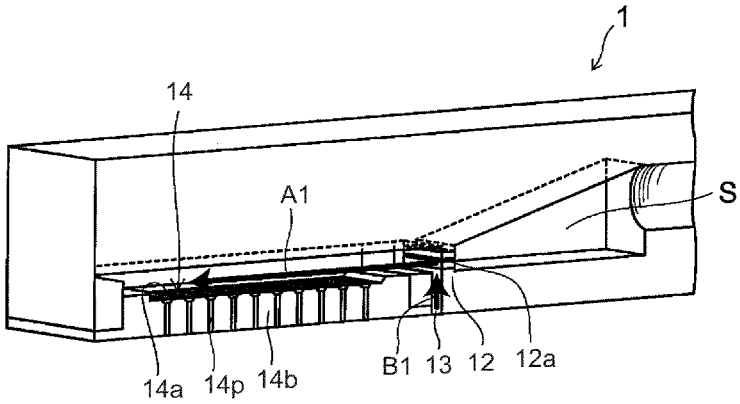
FIGS. 19A to 19C are schematic diagrams showing a shower apparatus according to a variation of the present invention by way of example.
Figure 19B:
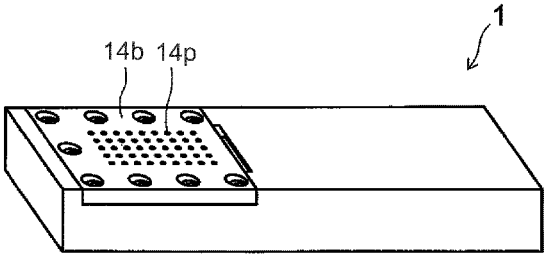
Figure 19C:
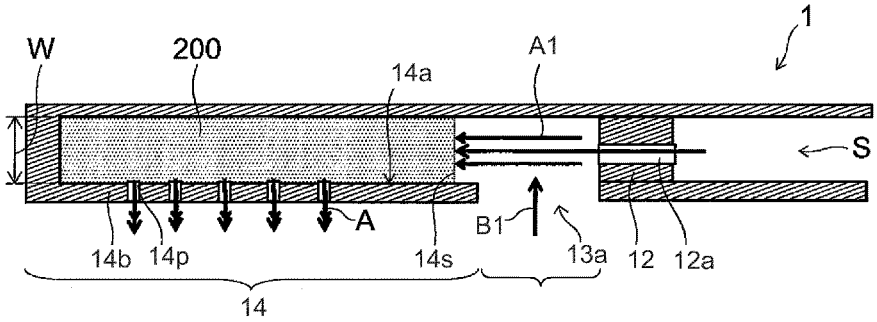

Next, variations of the first to third embodiments will be described by way of example. FIGS. 19A to 19C are schematic diagrams showing a shower apparatus 1 according to a variation of the present invention by way of example, where FIG. 19A is a schematic perspective sectional view of the shower apparatus, FIG. 19B is a schematic perspective view when the schematic perspective sectional view in FIG. 19A is seen from the bottom, and FIG. 19C is a schematic diagram conceptually showing a cross-sectional structure shown in FIG. 19A.

A shower apparatus 1 includes a water supply line S adapted to pass water, a throttle unit 12 installed on the water supply lines (at a downstream end of the water supply line S in FIG. 19) and adapted to discharge water by reducing a cross sectional area of a water flow channel, an aeration unit 13 installed downstream of the throttle unit 12 and adapted to aerate the water discharged from the throttle unit 12, and a nozzle unit 14 installed downstream of the aeration unit 13 and provided with a plurality of nozzle holes 14*p* adapted to discharge air-bearing water (bubble water) 200 which is water containing air. The throttle unit 12 has an opening (ejection hole 12*a*) and discharges water through the ejection hole 12*a*. The aeration unit 13 has an opening 13*a* and mixes the water (arrow A1) discharged from the throttle unit 12 with air (arrow B1) introduced through the opening 13*a*. The nozzle unit 14 includes a nozzle plate 14*b* provided with the plurality of nozzle holes 14*p*. Thickness W of an internal space of the nozzle unit 14 can be set to have a difference of a little less than 1 mm to about a few mm from the diameter or width of the ejection hole 12*a* in an up-and-down direction (direction of the thickness W).

The throttle unit 12 discharges water along the plane (nozzle face 14*a*) in which the plurality of nozzle holes 14*p* are provided. To "discharge water along the nozzle face 14*a*" means discharging water along the nozzle face 14*a* from immediately above the nozzle face 14*a* or discharging water substantially in parallel to the nozzle face 14*a* at a location spaced away from the nozzle face 14*a*. Incidentally, the direction of water discharge does not need to be strictly parallel to the nozzle face 14*a*.

When water is supplied to the water supply line S and shower flow is discharged from the nozzle unit 14, an interface 14*s* where the liquid is mixed with air is formed near a boundary between the aeration unit 13 and nozzle unit 14. On that side of the interface 14*s* which is closer to the aeration unit 13, the water from the throttle unit 12 is open to the atmosphere. On the side closer to the nozzle unit 14, the water from the throttle unit 12 is mixed with the air drawn in by the water, resulting in bubble water 200. That is, the water from the throttle unit 12 and the air drawn in by kinetic energy of the water collide with the interface 14*s*, mixing with each other, and thereby producing the bubble water 200.

Figure 20A:
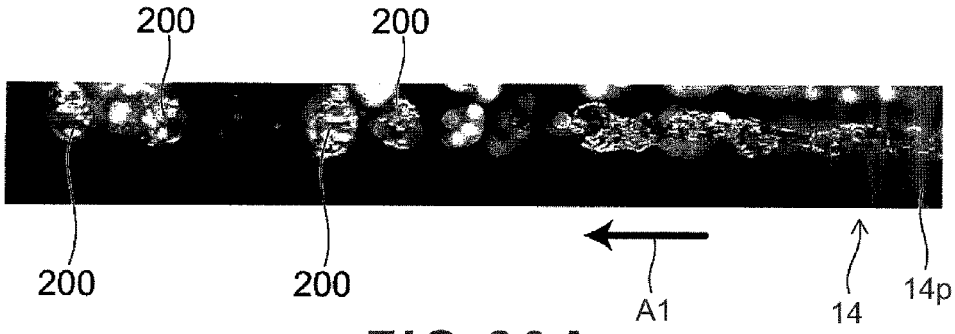
FIGS. 20A and 20B are photographs showing a mode of water discharge from nozzle holes.

Next, generation of bubble water in the shower apparatus 1 will be described with reference to FIGS. 20A and 20B, which are photographs showing a mode of water discharge from the nozzle holes 14*p*. That is, the photographs show how shower flow is discharged from the nozzle holes 14*p* of the nozzle unit 14 in the direction of the arrow. FIG. 20A shows a mode of water discharge when water (bubble water 200) containing air bubbles is discharged. It can be seen that the water 200 discharged from the nozzle holes 14*p* is made up of particles, each of which contains an air bubble. In this way, when air bubbles are mixed in, the bubble water 200 is liable to become particles after water discharge, and becomes larger particles than discharged water not containing air bubbles. It is considered that the particles are generated by the action of the air bubbles as well as by the shearing force of air. If the water becomes large particles, good stimuli and a quality feel are produced when the shower hit the body surface. Furthermore, when air is mixed in, since the flow rate of air is added to the flow rate of water, the flow velocity of discharged particles is increased. That is, when air is mixed in, the particle size is increased even with a small volume of water, and so is the flow velocity, increasing the kinetic energy of the particles and thereby producing a sufficient "sensation of impact."

Figure 20B:
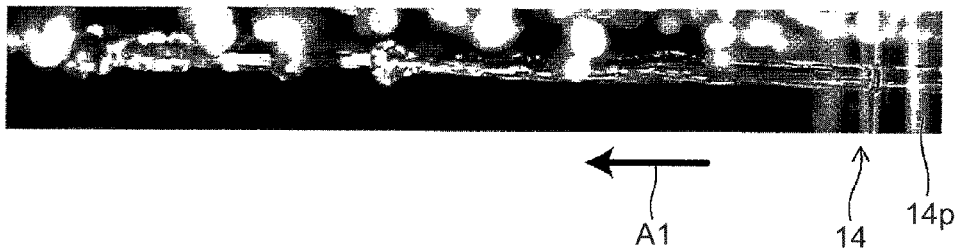

On the other hand, FIG. 20B shows a mode of water discharge when water not containing air bubbles is discharged. When air bubbles are not contained, water is less liable to become particles after water discharge and presumably a continuous water stream is broken up into particles by the shearing force of air. The size of the particles is proportional to the diameter of the nozzle holes 14*p*, and thus the particle size can be estimated approximately based on the hole diameter. It is known that the particle size is smaller than that of discharged water containing air bubbles. In this way, since the particle size is smaller than spray of a shower containing air bubbles, when the body surface is hit by the shower, a sufficient stimulus sensation and quality feel are not available. Thus, to obtain a sufficient "sensation of impact," it is necessary to increase the water volume and flow velocity, and thereby increase kinetic energy.

According to the present variation, as described with reference to FIG. 19, the throttle unit 12 discharges water along the nozzle face 14*a*. That is, the water discharged from the throttle unit 12 flows in the internal space of the nozzle unit 14 substantially in parallel to the nozzle face 14*a* without colliding with a wall or the like. Consequently, the water is discharged from the nozzle holes 14*p*, being mixed with air bubbles. That is, according to the present variation, to discharge water containing air bubbles both on the upstream and downstream sides of the nozzle unit 14, discharged water with large particles can be formed as shown in FIG. 20A. Consequently, sufficient stimuli and "sensation of impact" are available even with a small volume of water.

Figure 21A:
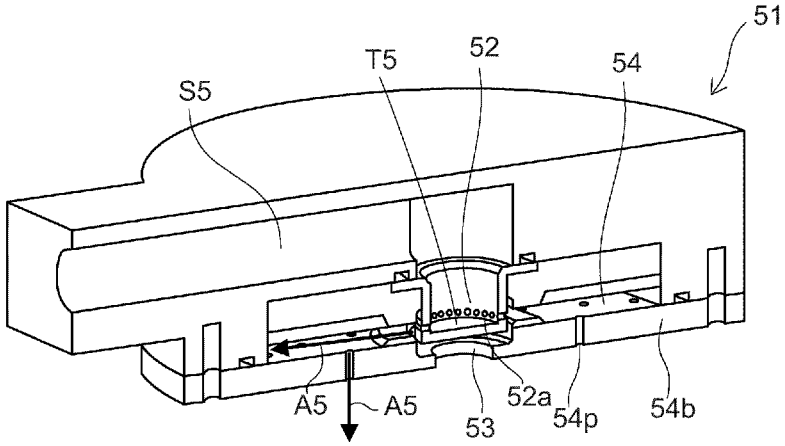
FIGS. 21A to 21C are schematic diagrams showing a shower apparatus according to a variation of the present invention by way of example.
Figure 21B:
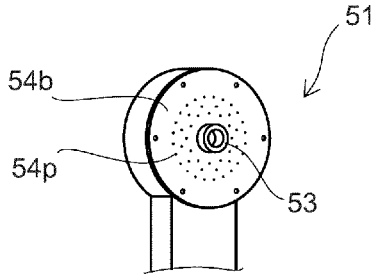
Figure 21C:
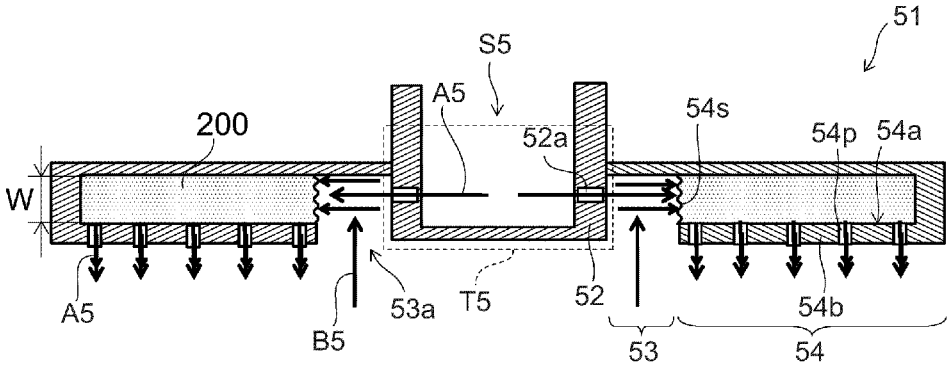
Figure 22:
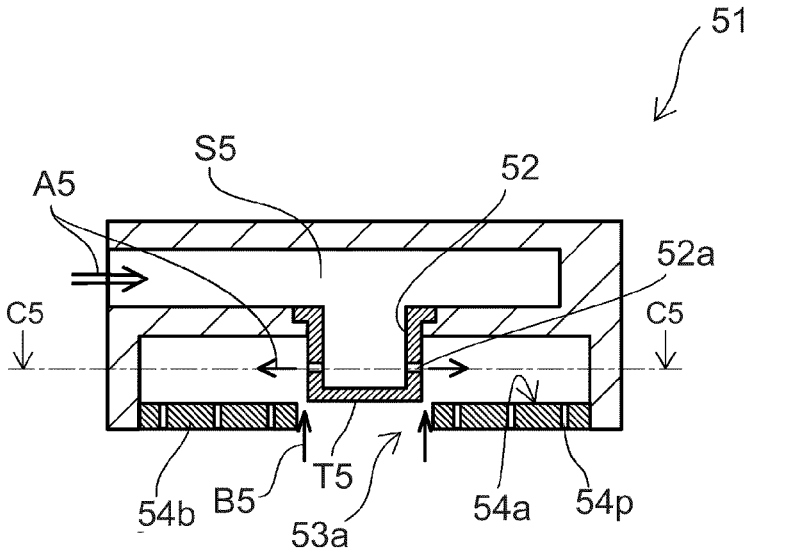
FIGS. 22A and 22B are schematic diagrams showing an example of the shower apparatus according to the variation in FIGS. 21A to 21C.
Figure 22:
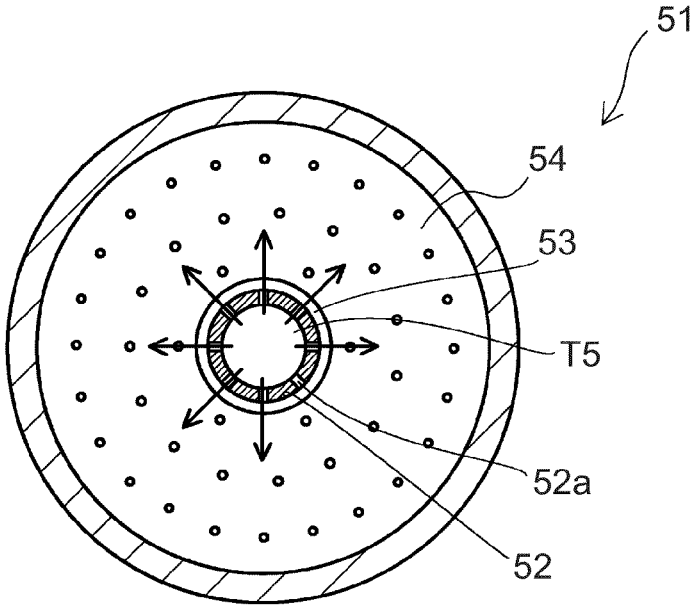

Next, a radial shower apparatus 51 according to a variation will be described with reference to FIGS. 21 and 22. FIGS. 21A to 21C are schematic diagrams showing the shower apparatus 51 according to the present variation by way of example, where FIG. 21A is a schematic perspective sectional view of the shower apparatus 51, FIG. 21B is a schematic perspective view when the schematic perspective sectional view in FIG. 21A is seen from the bottom, and FIG. 21C is a schematic diagram conceptually showing a cross-sectional structure shown in FIG. 21A. FIGS. 22A and 22B are schematic diagrams showing another configuration of the shower apparatus 51 by way of example, where FIG. 22A is a schematic sectional view of the shower apparatus 51 and FIG. 22B is a sectional view taken along line C5-C5 in FIG. 22B.

The shower apparatus 51 includes a water supply line S5 adapted to pass water, and a feed water receiving unit T5 installed on the water supply line S5 (at a downstream end of the water supply line S5 in FIGS. 21 and 22) and adapted to receive the water flowing through the water supply line S5, in a direction substantially parallel to a shower water discharge direction. The feed water receiving unit T5 includes a throttle unit 12 adapted to discharge water by reducing a cross sectional area of a water flow channel. The throttle unit 52 has an opening (ejection hole 52*a*) and discharges water through the ejection hole 52*a*.

Also, the shower apparatus 51 includes an aeration unit 53. The aeration unit 13 is installed downstream of the throttle unit 52 and adapted to aerate the water discharged from the throttle unit 52. The aeration unit 53 has an opening 53*a* and mixes the water (arrow A5) discharged from the throttle unit 52 with air (arrow B5) introduced through the opening 53*a*.

Also, the shower apparatus 51 includes a nozzle unit 54. The nozzle unit 54 is installed downstream of the aeration unit 53 and provided with a plurality of nozzle holes 54*p* adapted to discharge air-bearing water (bubble water) 200 which is water containing air. The nozzle unit 54 includes a nozzle plate 54*b* provided with the plurality of nozzle holes 54*p*. Thickness W of an internal space of the nozzle unit 54 can be set to have a difference of a little less than 1 mm to about a few mm from the diameter or width of the ejection hole 52*a* in an up-and-down direction (direction of the thickness W).

The throttle unit 52 discharges water along the plane (nozzle face 54*a*) in which the plurality of nozzle holes 54*p* are provided. To "discharge water along the nozzle face 54*a*" means discharging water along the nozzle face 54*a* from immediately above the nozzle face 54*a* or discharging water substantially in parallel to the nozzle face 54*a* at a location spaced away from the nozzle face 54*a*. Incidentally, the direction of water discharge does not need to be strictly parallel to the nozzle face 54*a*.

When water is supplied to the water supply line S5 and shower flow is discharged from the nozzle unit 54, an interface 54*s* where the liquid is mixed with air is formed near a boundary between the aeration unit 53 and nozzle unit 54. On that side of the interface 54*s* which is closer to the aeration unit 53, the water from the throttle unit 52 is open to the atmosphere. On the side closer to the nozzle unit 54, the water from the throttle unit 2 is mixed with the air drawn in by the water, resulting in bubble water 200. That is, the water from the throttle unit 52 and the air drawn in by kinetic energy of the water collide with the interface 54*s*, mixing with each other, and thereby producing the bubble water 200.

Incidentally, the water supply line S5 can be configured to extend in any direction at a location other than near the feed water receiving unit T5, for example, in a direction substantially perpendicular to the shower water discharge direction as shown in FIG. 22A.

The feed water receiving unit T5 can be installed substantially at the center of the nozzle unit 54. The throttle unit 52 of the feed water receiving unit T5 can be configured to discharge water radially through a plurality of ejection holes 52*a*. This configuration allows water to be discharged more uniformly from the nozzle unit 54.

Figure 23:
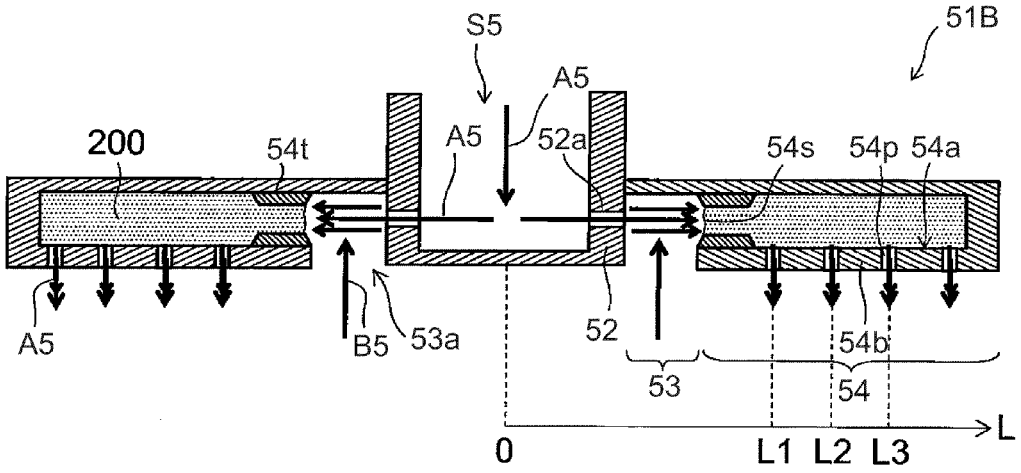
FIG. 23 is a schematic diagram showing an example of the shower apparatus according to the variation in FIGS. 21A to 21C.

FIG. 23 is a schematic sectional view showing a shower apparatus 51B used in an experiment. As shown in FIG. 23, the shower apparatus 51B includes a weir unit 54*t* described later. The weir unit 54*t* prevents the bubble water from flowing back toward the aeration unit 53.

Figure 24A:
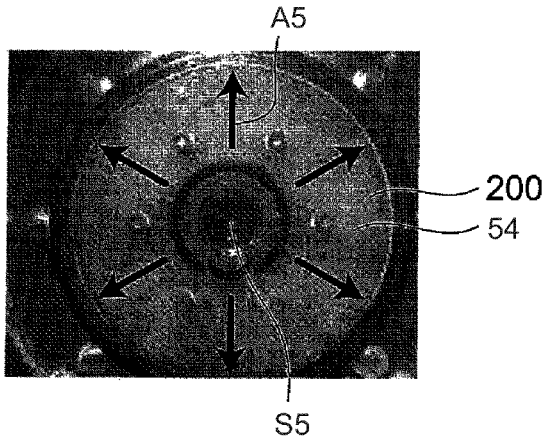
FIGS. 24A and 24B are photographs showing a state in a nozzle unit and a mode of water discharge from nozzle holes when the shower apparatus in FIG. 23 is used.
Figure 24B:
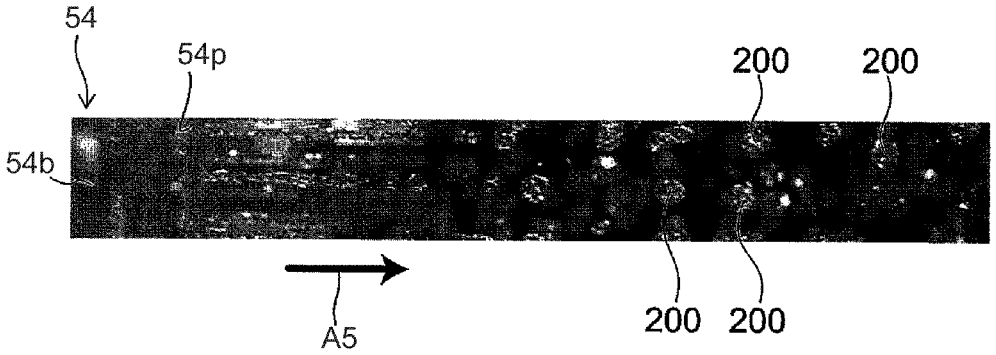

FIGS. 24A and 24B are photographs showing a state in the nozzle unit 54 and a mode of water discharge from the nozzle holes 54*p* when the shower apparatus 51B in FIG. 23 is used, where FIG. 24A is a plan view photo when the inside of the nozzle unit 54 is observed from above while FIG. 24B is a side view photo showing the mode of water discharge from the nozzle holes 54*p* as viewed from an outer peripheral side.

It can be seen from FIG. 24A that in the shower apparatus 51B, an appropriate quantity of air bubbles are mixed uniformly in the nozzle unit 54 from central part (upstream side) to outer peripheral part (downstream side). There is no stagnation of air bubbles and the air bubbles are flowing toward the outer periphery by maintaining their small diameters. Consequently, the bubble water 200 can flow out of the nozzle holes 54*p* appropriately. This means that the air bubbles are kept from uniting with each other and resulting in stagnation. Thus, swirls and backflow are less liable to occur and consequently there is not much loss of kinetic energy. Even when baffle ribs or the like are used, it is considered that bubble connection, swirls, and backflow are less liable to occur than in the conventional art.

As can be seen from FIG. 24B, the bubble water 200 discharged evenly from all the nozzle holes 54*p* including the outer peripheral side has a high bubble content and large particle size. This is because small air bubbles are mixed uniformly in the nozzle unit 54 ranging from the central part to the outer peripheral part.

With the shower apparatus 51B, the bubble content in the entire shower was 2.5% or more at a flow rate of about 6.5 liters/minute whereas a conventional bubble content was approximately 25% at a flow rate of about 11 liters/minute.

In this way, with the shower apparatus 51B, the particle size and flow velocity of the shower are maintained at appropriate levels in the nozzle unit 54 from the central part to the outer peripheral part. This provides a shower with a good quality feel. A non-radial shower apparatus 51 can also be discussed in a manner similar to the shower apparatus 51B.

The plurality of nozzle holes 54*p* can be provided at locations spaced away from the throttle unit 52. The meaning of this will be described below. Air is drawn toward water by the kinetic energy of the water released into the atmosphere from the throttle unit 52. In so doing, the amount of drawn air is proportional to the velocity and surface area of the water discharged from the throttle unit 52. The discharged water and drawn air are mixed together by colliding with an air-liquid interface 54*s* formed near the boundary between the aeration unit 53 and nozzle unit 54.

As the plurality of nozzle holes 54*p* are provided at locations spaced away from the throttle unit 52, the throttle unit 52 and air-liquid interface 54*s* are spaced away from each other, increasing the contact surface area of the water discharged from the throttle unit 52 with air. Consequently, air can be drawn in efficiently even if the flow velocity (pressure loss) in the throttle unit 52 is not increased. This increases an air content.

The distance from the throttle unit 52 to the nozzle holes 54*p* can be set, for example, to 15 mm or more. If the distance is too short, the water and air will collide with the air-liquid interface 54*s* while a velocity boundary layer formed around the water discharged from the throttle unit 52 is not yet grown, where the velocity boundary layer is a layer formed between high-velocity water and low-velocity air existing around the water. Consequently, the water discharged from the throttle unit 52 cannot have sufficient surface area. This may result in a reduced air content. On the other hand, if the throttle unit 52 and nozzle holes 54*p* are spaced away from each other, for example, by 15 mm or more, the velocity boundary layer formed around the water discharged from the throttle unit 52 grows sufficiently, allowing the water to have sufficient surface area and resulting in increased air content.

In this way, by providing the plurality of nozzle holes 54*p* at locations spaced away from the throttle unit 52, it is possible to increase the air content and thereby form the bubble water 200 properly.

Incidentally, according to the present variation, since the water stream discharged from the throttle unit 52 has nothing to collide with directly until flowing out to the nozzle holes 54*p*, the bubble water in the nozzle unit 54 can be straightened more effectively. This reduces loss of kinetic energy.

In this way, according to the present variation, the particle size and flow velocity of the shower can be maintained at appropriate levels. This provides a shower with a good quality feel as well as provides comfortable stimuli. The present variation can be applied especially effectively to areas with low water pressure. Also, the large particle size has the secondary effect of reduced heat radiation. The present variation can suitably be applied to a hand-held shower head, fixed shower head, and the like used in a bathroom, kitchen, or the like.

Next, components of the present variation will be described with reference to FIGS. 25 to 27. In the present variation, the throttle unit 12 has one or more openings such as orifices (ejection hole 12*a*) to discharge water. If there are more than one ejection hole 12*a*, at least two water streams discharged through the plurality of ejection holes 12*a* may be directed in a plurality of different directions corresponding to the ejection holes 12*a*. Also, at least two discharge channels of the water discharged through the plurality of ejection holes 12*a* may be located on different planes.

Figure 25A:
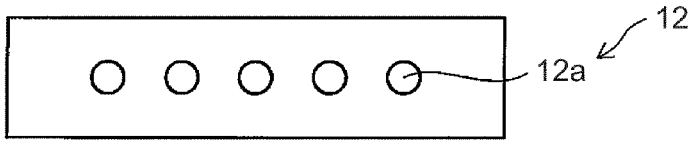
FIGS. 25A and 25B are schematic side views showing ejection holes by way of example.
Figure 25B:
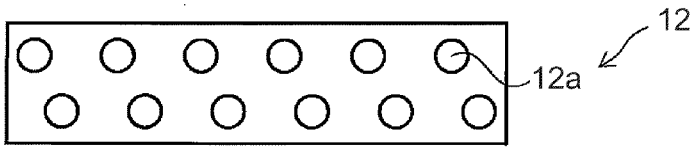

FIGS. 25A and 25B are schematic side views showing the ejection holes 12*a* by way of example. As shown in FIG. 25A, the ejection holes 12*a* may be configured to have a circular shape or the like and formed in an interspersed fashion. Alternatively, as shown in FIG. 25B, the ejection holes 12*a* may be arranged in a staggered (zigzag) fashion. That is, at least two of the ejection holes 12*a* are located at different distances from the nozzle face 14*a*. This configuration causes the discharge channels of the discharged water to be placed on different planes and causes the flow channels of discharged water streams to be arranged densely. This prevents the bubble water 200 from flowing back toward the aeration unit 13 in FIG. 19C. That is, the interface 14*s* can be formed appropriately. Hereinafter this effect will be referred to as a "shield effect." Also, if a plurality of the ejection holes 12*a* are arranged in a staggered (zigzag) fashion, contact area of the discharged water with air is increased, improving the air content.

Next, another configuration of the nozzle unit 14 will be described with reference to FIGS. 26 and 27, which are schematic sectional views showing the nozzle unit 14 by way of example. As shown in FIGS. 26A and 26B, the thickness W of the internal space of the nozzle unit 14 may be decreased with increasing distance from the throttle unit 12. Consequently, the flow velocity of the water can be maintained at an appropriate level.

Figure 26A:
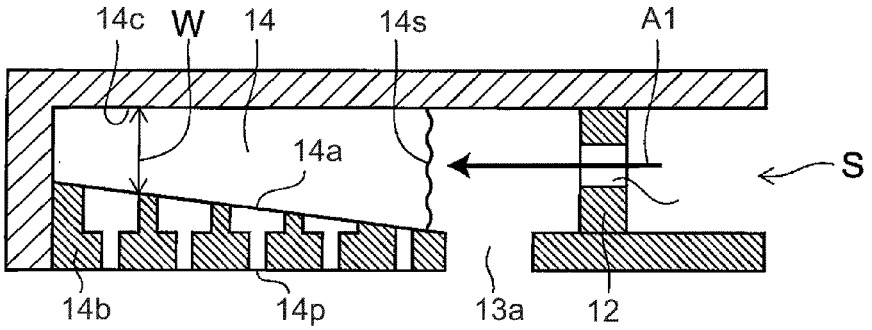
FIGS. 26A and 26B are schematic side views showing a nozzle unit by way of example.
Figure 26B:
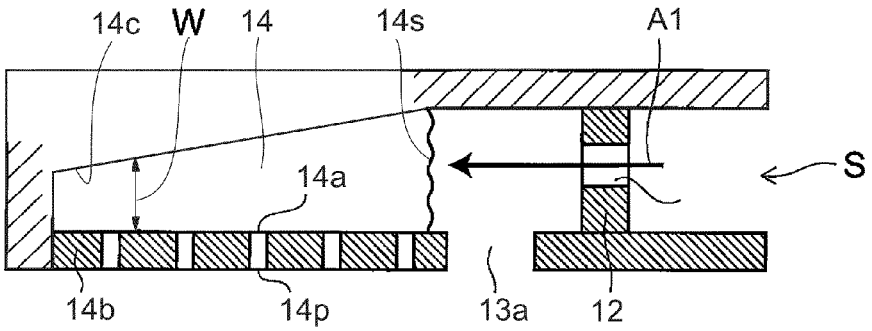

For example, as shown in FIG. 26A, the nozzle face 14*a* may be configured to incline toward an opposing face 14*c* as it goes downstream. Also, as shown in FIG. 26B, the opposing face 14*c* may be configured to incline toward the nozzle face 14*a* as it goes downstream.

Incidentally, the cross sectional area of the flow channel for the nozzle holes 14*p* may be varied between inner and outer sides of the nozzle unit 14 as shown in FIG. 26A. For example, the cross sectional area of the flow channel may be relatively reduced on the outer side. Consequently, the flow velocity of the bubble water discharged from the nozzle holes 14*p* can be maintained at an appropriate level.

Figure 27A:
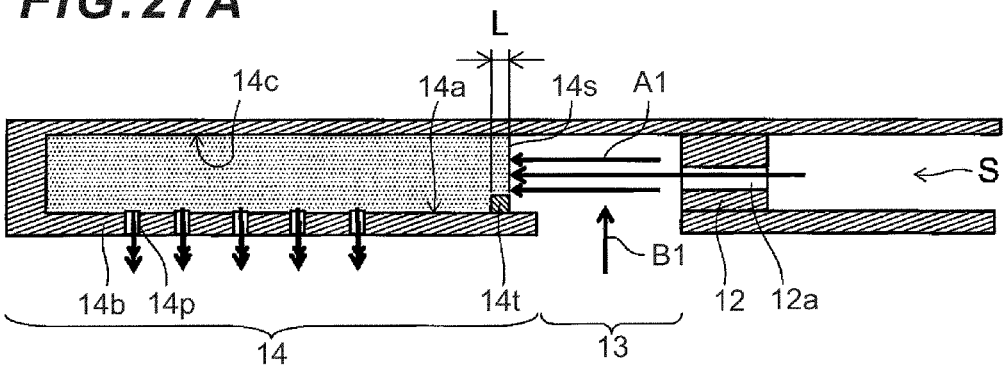
FIGS. 27A and 27B are schematic side views showing a nozzle unit by way of example.
Figure 27B:
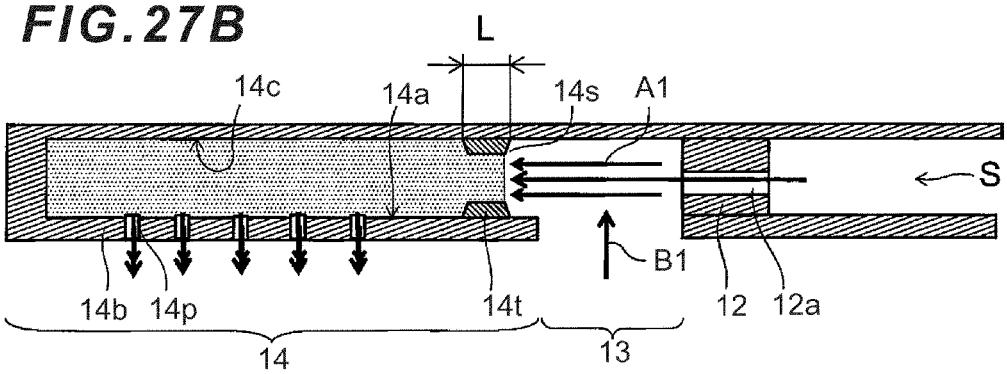

Also, as shown in FIGS. 27A and 27B, the nozzle unit 14 may be configured to have a weir unit 14*t* at a boundary with the aeration unit 13. Consequently, a boundary layer is formed in a gap between the weir unit 14*t* and the water discharged from the throttle unit 2, improving the shield effect for the interface 14*s*. In this case, as shown in FIG. 27B, the weir unit 14*t* may be installed in both upper and lower parts of the nozzle unit 14 (on the opposing face 14*c* and nozzle face 14*a*).

Embodiments of the present invention have been described above with reference to concrete examples. However, the present invention is not limited to these concrete examples. That is, when those skilled in the art make design changes to any of the concrete examples, the resulting variations are also included in the scope of the present invention as long as the variations contain features of the present invention. For example, the components of the above-described concrete examples as well as the arrangements, materials, conditions, shapes, sizes, and the like of the components are not limited to those illustrated above, and may be changed as required. Also, the components of the above-described embodiments may be combined as long as it is technically possible, and the resulting combinations are also included in the scope of the present invention.

What is claimed is:

1. A shower apparatus for discharging aerated bubbly water, comprising:

a water supply unit adapted to supply water;

a throttle unit installed downstream of the water supply unit and adapted to make a cross sectional area of a flow channel smaller than the water supply unit and thereby eject passing water downstream;

an aeration unit installed downstream of the throttle unit and provided with an opening adapted to produce the bubbly water by aerating the water ejected through the throttle unit;

a nozzle unit installed downstream of the aeration unit and provided with a plurality of nozzle holes adapted to discharge the bubbly water by being formed along an ejection direction of the water ejected through the throttle unit; and rod-shaped projections configured to project into the nozzle unit, wherein the throttle unit is made up of a plurality of throttle channels arranged side by side;

each of virtual water ejection straight lines obtained by extending the ejection direction of the water ejected from each of the plurality of throttle channels to a position interfering with an inner wall of a flow channel which is formed downstream of the throttle unit does not interface with the inner walls of the aeration unit and a nozzle face in which the nozzle holes are formed;

the bubbly water is produced when the water ejected from the throttle unit plunges into an air-liquid interface between air and the water temporarily pooled in the aeration unit and nozzle unit; and the rod-shaped projections are adapted to divide a water stream generated by the nozzle unit by the water plunging into the air-liquid interface into substreams.

2. The shower apparatus according to claim 1, wherein that cross section of each of the aeration unit and the nozzle unit which is orthogonal to the ejection direction of the water ejected from the plurality of throttle channels is formed into a flat shape whose longer sides run along a direction in which the plurality of throttle channels are arranged side by side.

3. The shower apparatus according to claim 1, wherein the throttle unit is made up of the plurality of throttle channels arranged side by side in each of a plurality of tiers.

4. The shower apparatus according to claim 3, wherein the plurality of throttle channels arranged side by side are placed alternately in the plurality of tiers such that each throttle channel will be placed at an equal distance to a respective pair of throttle channels installed in an adjacent tier.

5. The shower apparatus according to claim 1, wherein those side walls of each of the aeration unit and the nozzle unit which face each other across the ejection direction of the water ejected from the throttle unit are placed so as to be parallel to each other.

6. The shower apparatus according to claim 1, wherein:

the bubbly water is produced when the water ejected from the throttle unit plunges into an air-liquid interface between air and the water temporarily pooled in the aeration unit and nozzle unit, and the shower apparatus further comprises deceleration means adapted to decelerate the water plunging into the air-liquid interface, before reaching first-row nozzle holes formed closest to the aeration unit out of the plurality of nozzle holes.

7. The shower apparatus according to claim 6, wherein the deceleration means comprises cross sectional area varying means formed in the aeration unit to reduce, on the side of the throttle unit, a cross sectional area orthogonal to the ejection direction of the water ejected from the throttle unit.

8. The shower apparatus according to claim 7, wherein the cross sectional area varying means is configured by varying, in the aeration unit, the cross sectional area orthogonal to the ejection direction of the water ejected from the throttle unit, in a direction along a plane in which the nozzle holes of the nozzle unit are formed.

9. The shower apparatus according to claim 8, wherein the cross sectional area varying means is configured by gradually varying, in the aeration unit, the cross sectional area orthogonal to the ejection direction of the water ejected from the throttle unit.

10. The shower apparatus according to claim 6, wherein the deceleration means comprises position control means adapted to position the air-liquid interface between the throttle unit and the first-row nozzle holes.

11. The shower apparatus according to claim 10, wherein the position control means is configured by placing a plurality of throttle channels in parallel in the throttle unit.

12. The shower apparatus according to claim 11, wherein the throttle unit is configured by placing the plurality of throttle channels in parallel with each other in a plurality of tiers.

13. The shower apparatus according to claim 10, wherein the position control means comprises an abrupt expansion portion adapted to abruptly expand, along a traveling direction of the water, the cross sectional area orthogonal to the ejection direction of the water ejected from the throttle unit in the aeration unit.

14. The shower apparatus according to claim 13, wherein the abrupt expansion portion expands the cross sectional area on a side where the nozzle holes are formed in the nozzle unit.

15. The shower apparatus according to claim 1, wherein:

the rod-shaped projections and the nozzle holes are arranged so as not to overlap in a heading direction of the water stream generated in the nozzle unit by the water plunging into the air-liquid interface; and the water stream generated in the nozzle unit by the water plunging into the air-liquid interface is divided by the rod-shaped projections and the resulting substreams tending to spread in a lateral direction are caught by the nozzle holes and thereby discharged before spreading excessively.

16. The shower apparatus according to claim 15, wherein a plurality of the rod-shaped projections are installed, being scattered in a depth direction of the nozzle unit corresponding to the heading direction of the water stream, so as to be able to divide the water stream generated in the nozzle unit by the water plunging into the air-liquid interface into substreams a plurality of times.

17. The shower apparatus according to claim 16, wherein the rod-shaped projections are configured to allow the substreams to reunite.

18. The shower apparatus according to claim 17, wherein the plurality of the rod-shaped projections are installed, being lined up along the heading direction of the water stream generated in the nozzle unit by the water plunging into the air-liquid interface.

19. The shower apparatus according to claim 1, wherein those side faces of the rod-shaped projections which face the throttle unit are configured to protrude toward the throttle unit.

* * * * *